US005770928A

United States Patent [19]

Chansky et al.

[11] Patent Number: 5,770,928

[45] Date of Patent: Jun. 23, 1998

[54] DIMMING CONTROL SYSTEM WITH DISTRIBUTED COMMAND PROCESSING

[75] Inventors: Leonard Chansky, Northridge; Ken Vannice, Los Angeles; Wiley Gilreath, Simi Valley; Craig LeVasseur, Camarillo, all of Calif.

[73] Assignee: NSI Corporation, Wilsonville, Oreg.

[21] Appl. No.: 552,056

[22] Filed: Nov. 2, 1995

[51] Int. Cl.[6] ..... H05B 37/02

[52] U.S. Cl. ..... 315/362; 315/295; 315/199; 315/DIG. 4; 361/600; 361/697; 361/724; 361/826

[58] Field of Search ..... 315/291, DIG. 4, 315/295, 312, 313, 362, 199; 361/600, 614, 683, 697, 715, 720, 724, 730, 736, 748, 752, 796, 797, 826

[56] References Cited

U.S. PATENT DOCUMENTS

| | | | |
|---|---|---|---|
| 4,972,125 | 11/1990 | Cunningham et al. | 315/291 |
| 4,977,484 | 12/1990 | Cunningham et al. | 361/429 |
| 5,004,957 | 4/1991 | Cunningham | 315/199 |
| 5,323,088 | 6/1994 | Cunningham | 315/195 |
| 5,352,958 | 10/1994 | Cunningham | 315/291 |

*Primary Examiner*—Robert Pascal
*Assistant Examiner*—Haissa Philogene
*Attorney, Agent, or Firm*—Marger, Johnson, McCollom & Stolowitz, PC

[57] ABSTRACT

A dimming control system includes dimmer modules which receive dimming level information from a control module. Each dimmer modules includes a microprocessor which provides internal intelligence for controlling power to a load in response to the dimming level information. The control module receives industry standard protocol dimming information from various sources, converts it to dimming level information, and communicates the dimming level information to the dimmer modules through serial communication lines. The dimmer modules and control module are mounted in a rack which includes a backplane having nonvolatile memory device that retains configuration data even if the control module is removed from the rack. The dimmer modules implement a zero cross prediction method which includes detecting an actual zero cross, calculating an error, and adding the error to the period of a line power signal. The error is calculated by applying a median filter to a plurality of previous error values, discarding the highest and lowest values of the previous error values, and averaging the remaining previous error values.

41 Claims, 22 Drawing Sheets

DIMMING CONTROL SYSTEM WITH DISTRIBUTED COMMAND PROCESSING

BACKGROUND OF THE INVENTION

Field of the Invention

The present invention relates to dimming control systems employing interchangeable dimmer modules and enclosures for mounting such dimmer modules. More particularly, the present invention relates to a unique dimmer module architecture employing on board intelligence for dimming control and a rack mounting system for the intelligent dimmer modules employing dual communications control modules for communication with individual dimmer modules in the rack and non-volatile memory in the rack backplane for storage of configuration information and independent operating parameters.

Lighting control systems for architectural, theatrical and movie/television applications typically incorporate numerous individual dimmer circuits which are rack mounted at central locations for control of disbursed individual and grouped incandescent or inductive loads. Conventional dimming communications protocols have been developed for various input communications devices to communicate with rack mounted dimmers and typically individual racks incorporate a controller for receiving such commands and distributing commands to the individual dimmer modules.

Various technologies have been employed for individual dimmers including choke based and electronic dimmer systems. Control of both types of systems has been accomplished using pulse width modulated (PWM) control approaches. Consolidation of processing in a centralized controller for large numbers of dimmer control circuits creates significant complexity in the controller. It is therefore desirable to distribute control functions while centralizing communications for dimmer rack systems. Such distributed processing is also particularly advantageous with newly developed lighting control systems employing local area networks for command and control communication.

Dimming racks in the prior art typically support numerous dimmer modules. To allow flexibility in lighting requirements, dimmer racks must support dimmer modules having varying power ratings and physical interconnection requirements for load outputs. It is therefore desirable for dimmer racks to incorporate means for assuring mating of properly configured dimmer modules with compatible load and wiring configurations within the rack while maintaining commonality of interface structure to reduce cost and complexity in the rack system. The capability to preconfigure racks with specific dimmer module information and to provide redundant control capability for system failures, panic mode operations and independent control of rack based looks for lighting controlled by the racks is desirable.

The present invention provides the desired features overcoming deficiencies in the prior art while maintaining produceability of both dimmer racks and dimmer modules for cost considerations and commonality with prior art control systems.

SUMMARY OF THE INVENTION

The dimming control system with distributed command processing comprises a rack having a plurality of slots for dimmer modules, each slot having supports formed by a punch and break process on an inner sheet metal panel of the walls of the rack. Each slot incorporates load connectors and communication board connectors mounted in spaced relation from one wall of the rack to engage mating connectors in inserted dimmer modules. Power bus connection is accomplished by multiple blade conductors mounted adjacent one wall of the rack opposite the wall supporting the load and board connectors.

A pull out tray located at the bottom of the rack receives two control modules providing data communications for level and configuration control to the individual dimmers in the dimmer modules. A backplane for the rack resides on the rear wall of the pull out tray allowing easy access to backplane connectors by removal of the control modules and extraction of the tray. A non-volatile memory system present in the backplane stores rack configuration data and dimmer looks for independent operation of the rack dimmers. This data is retained in the rack after setup even if control modules are removed or exchanged.

Dimmer Modules in the system incorporate a chassis engaged by the slot supports in the rack. A side load spring mounted on one side of the chassis urges the dimmer module against the opposite side wall of the rack thereby creating a high tolerance datum for board connector placement. A floating power connector is mounted in the chassis to receive the power bus blade. A full slot height lobed leaf spring for the side load spring prevents airflow in the rack slot outside the vented dimmer module itself and also provides secondary function as a ground contact. A three point keying system on the high tolerance wall of the rack prevents insertion of improperly rated dimmer modules in prewired slots.

Each dimmer module incorporates a power device having an on board microcontroller for dimming level control. Dimmer levels are provided as serial communication from the control modules in the rack to the dimmer module microcontroller which provides local generation of PWM gating for SCR control in the power device. Internal intelligence in the dimmer module provided by the microcontroller allows individual dimmer control, diagnostics and calibration functions not possible in the prior art including module presence detection, type identification, load current sensing, open load sensing, circuit breaker open sensing, increased power control accuracy and individual temperature monitoring and control. In addition, panic switching is accomplished at each individual module through detection of DIP switches at each slot location by the microcontroller, independent of the presence or status of any control module in the rack.

Local rack control is accomplished through a hand held controller removably mounted in the door of the rack with a display visible through a window in the door for monitoring with the door closed and the rack in operation. Connection through the backplane connectors is provided for industry standard dimming control protocol and local area network control system.

BRIEF DESCRIPTION OF THE DRAWINGS

The configuration and advantages of the present invention will be better understood by reference to the following drawings wherein.

DETAILED DESCRIPTION OF THE INVENTION

Figure 1:
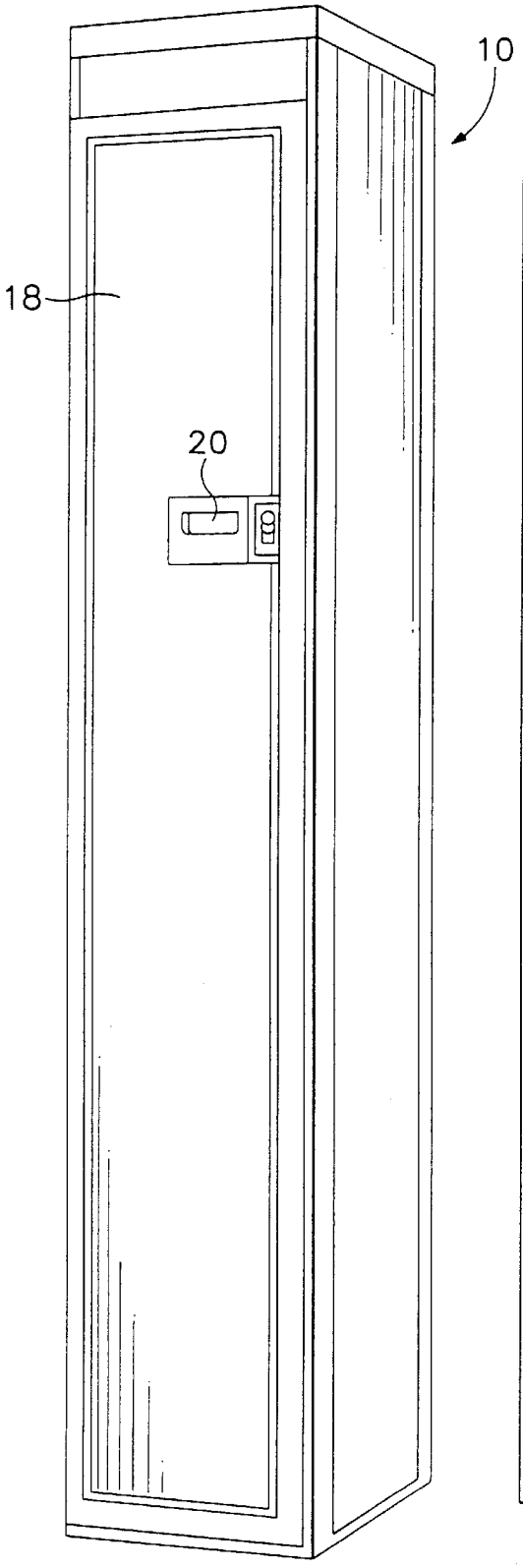
FIG. 1 is a front elevation view of a dimmer rack according to the present invention.
Figure 3A:
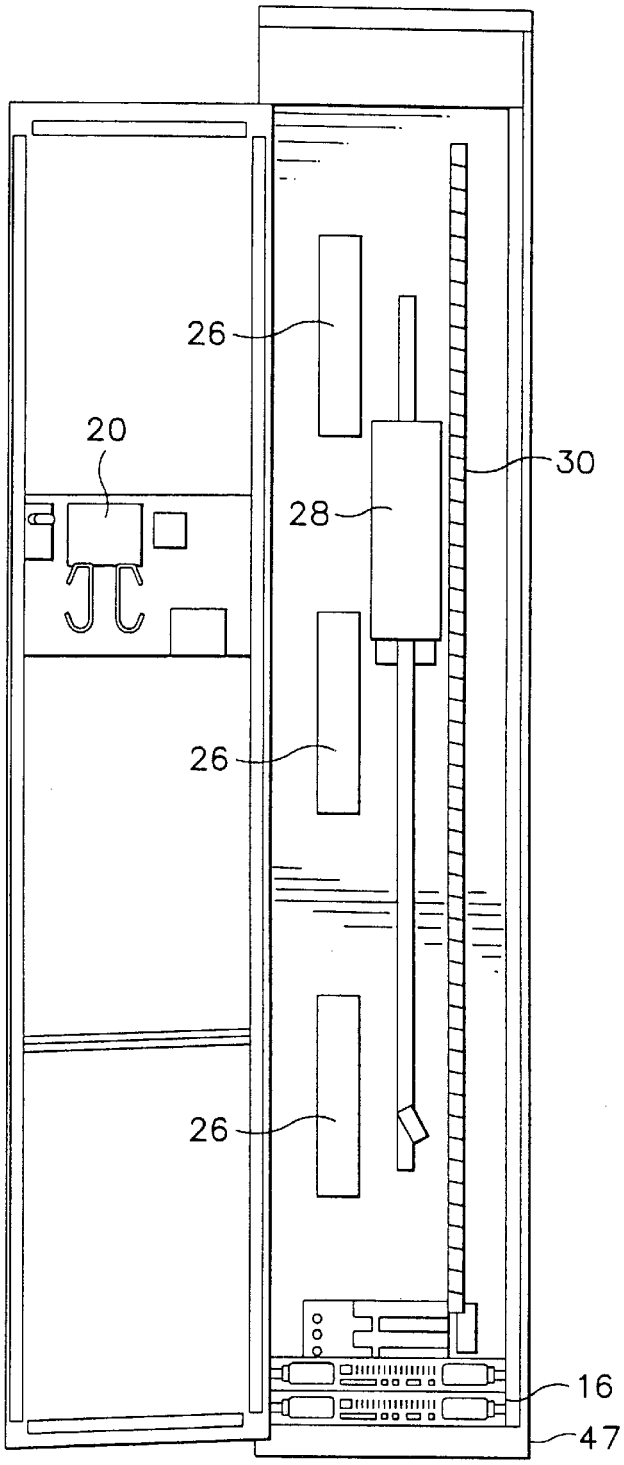
FIG. 3*a* is a front elevation view of the dimmer rack of FIG. 2 with all dimmer modules removed.
Figure 2:
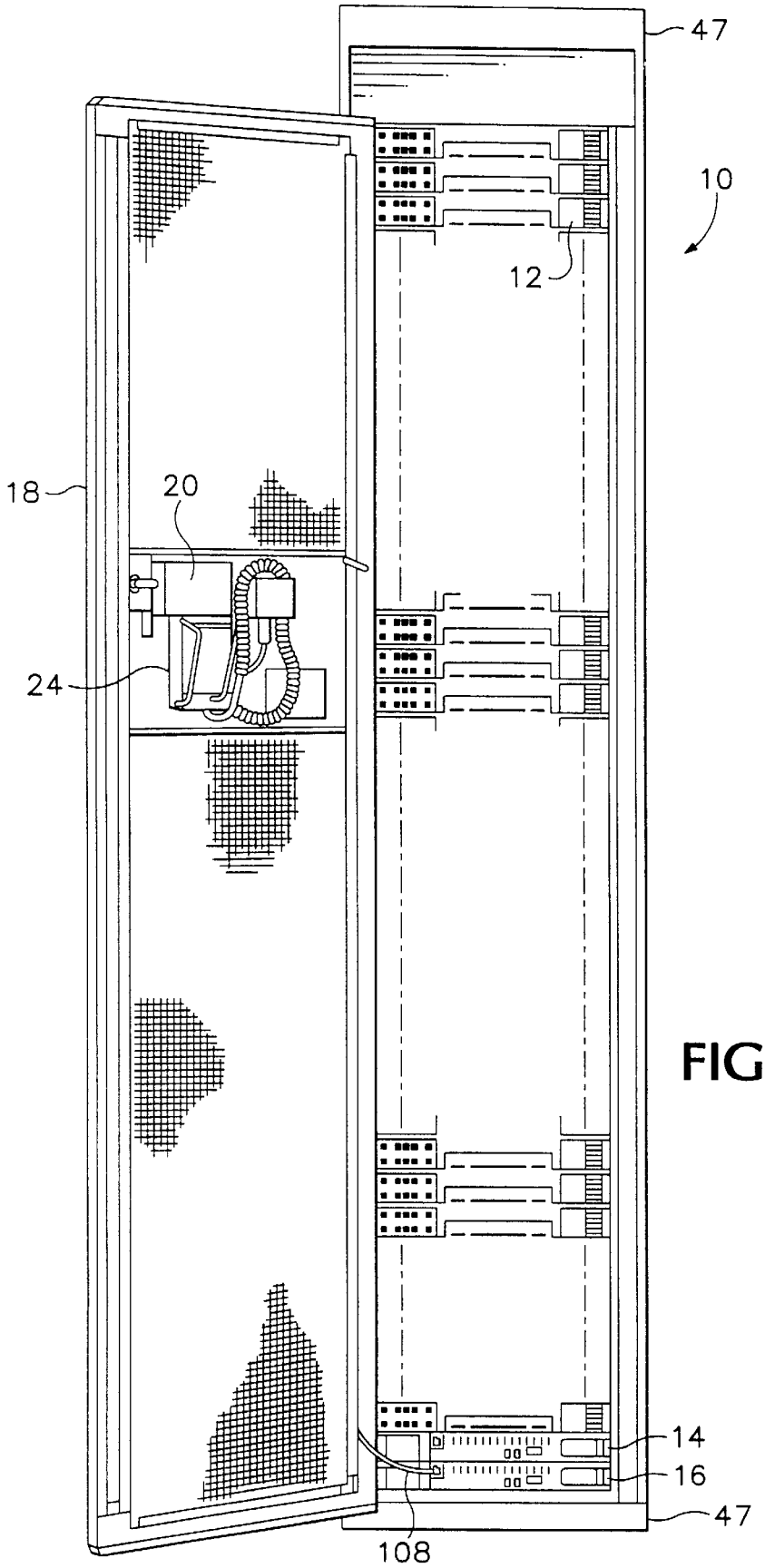
FIG. 2 is a front elevation view of the dimmer rack of FIG. 1 with the door open showing installed position of the dimmer modules.

A complete dimming control system constituting the present invention is shown in FIGS. 1 and 2. The dimming rack 10 comprises a structure having a plurality of integral supports to receive dimming modules 12 into a plurality of slots. Two control modules 14 are mounted in respective slots of a pull out tray 16 located in the bottom of the rack. A door 18 provides a closure for the rack and incorporates a viewing window 20 for the display of a hand held controller 22 held in a carrier 24 mounted to the interior of the door.

Details of the structural arrangement of the rack are best seen in FIGS. 3*a–d* shown with the dimmer modules removed from the rack. Power feed buses 26 each receiving power from one phase of a three phase supply are provided at three locations on the left side of the rack vertically spaced such that each blade of the power bus feed supplies one-third of the slots for dimmer modules. In alternative embodiments for single phase power applications, two power bus blades each feeding half the slots may be employed. A neutral bus 28 is mounted to the right of the center line in the cabinet to receive neutral connections. Load terminals 30 corresponding to each slot in the dimmer rack are mounted on a main insulator 32 adjacent the right hand wall of the rack and control signal cards 34 terminating in edge connectors are mounted intermediate the load terminals and right wall of the rack.

Supporting slots for the dimmer modules are formed in interior sheet metal panels 38 on the left and right walls of the cabinet by a precision punch and brake operation forming a forward support guide 40 and a rearward support guide 42 for each slot on each side of the cabinet. Keying to avoid placement of an improperly rated dimmer module in a pre-wired slot in the rack is accomplished using a punched metal tab 44 and two retaining screw holes 46 and 48 in each slot. The punch tab is located forward of the retaining screw holes for initial engagement of a mating protrusion, which on present embodiments comprises a counter sink screw head having an angle complimentary to the angle of the tab, mounted on higher amperage dimmer modules as will be described in greater detail subsequently. Keying for higher power modules is accomplished by physically removing the punch tab by bending into the punch aperture flush with the wall to allow engagement of a retaining screw mounted in hole 48 depending on the type of module for which the slot has been wired. A screw present in hole 48 will prevent installation of the highest amperage rated dimmer module while no tab or screw allows any amperage dimmer into a slot wired for the highest amperage rating. Hole 46 is provided for insertion of a screw to act as a replacement for the keying tab if the tab is removed and subsequent use of that slot for a lower power module is required. The triple keying approach provides great flexibility in pre-wiring slots for various dimmer module configurations.

The dimmer rack is of modular configuration employing extruded corner posts 45 mounted between base and top frame members 47. The interior sidewall panels 38 previously discussed are attached to the corner posts and exterior panels 49 provide a finished appearance for the rack attaching to the corner posts through blind fastening arrangements.

The interior of the rack incorporates a wiring compartment 50 for routing of electrical cabling and acting as a plenum for cooling airflow drawn through the dimmer modules located at the front of the rack through cooling exhaust fans mounted in the top frame of the rack. Cable carriers 52 mounted using blind nut capture in channels extruded in the corner posts are employed for collection and routing of load cabling and other electrical wiring as required in the rack. The cable carriers are adjustable to any desired height using the blind nut arrangement and comprise a metallic hoop 54 extending from an attachment plate 56. The metallic hoop terminates to provide a wire insertion slot 58 to allow wiring to be inserted into the carrier without disconnecting one end. The routing of cabling internal to the rack enhances cooling airflow in the plenum for consistent airflow through dimmer modules mounted in the rack.

The dual control modules 14 of the dimmer rack reside in pull out tray 16 located at the bottom of the rack. A slot 60 in each side of the pull out tray receives a guide 62 formed in the interior side panel of the rack using a punch and brake process identical to the forming of the guides for the dimmer slots previously discussed. A pair of guides 64 and 68 are formed in the walls of each side of the pull out tray forming two slots to receive the two control modules within the tray.

The back wall 70 of the removable control module tray constitutes the "backplane" for the dimmer rack on which dimmer control cable connectors 72, for connection of the control modules to the individual dimmers mounted in the racks, are mounted as well as connectors for industry standard dimmer control protocol input 74, panic terminal input 76 and remote hand-held terminal connections 78. In addition, standard LAN connections, such as Ethernet®, are wired to the backplane using standard BNC or similar shielded cable from connectors mounted on the exterior of the rack. The industry standard dimming control protocol data input, panic data input and remote hand-held terminal input are wired on the backplane for connection to the mating connectors 28 on the rear of the control modules 14. In addition, a printed circuit board 80 carrying non-volatile random access memory (NVR) and associated communications circuitry is mounted to the backplane for rack configuration data storage as will be described in greater detail subsequently.

In the embodiment shown and described herein, each of the control modules employs a Motorola 68302 Central Processing Unit 302 interfacing with two Hitachi H8/327 microcontrollers 304, 306 for communications. Each control module incorporates a module selection button 82 for activation of the chosen control module, a serial data port 84 for connection to a personal computer for programming of the rack, a memory card interface including card receiver slot 86, write card command button 88 and read card command button 90. A memory card ejection lever 92 adjoins the memory card slot. A multi-conductor cable connector 94 is provided on the front panel of each control module for connection of the rack mounted hand-held controller for direct programming and operation of the rack as will be described in greater detail subsequently.

Figure 11:
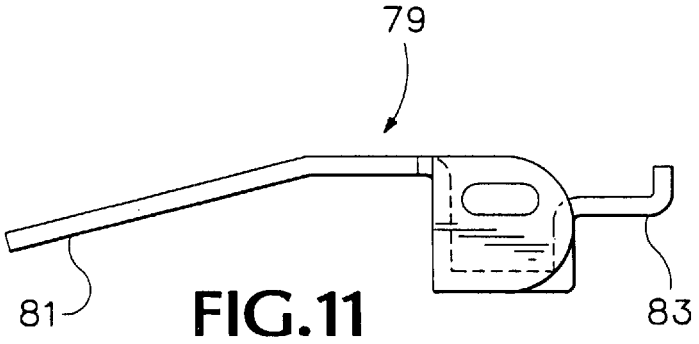
FIG. 11 is a detailed view of the control module clamping arrangement.

Physical insertion of the control modules into the module tray is assisted by the clamps 79 shown in detail in FIG. 11. The clamps incorporate a grip 81 opposite a tang 83 which is received by a channel in the extruded corner post of the rack. Insertion of the module into the tray with the grips extending from the face of the module and then pressing the grips toward the module face engages the tangs in the channels and, urged by the off center pivot point of the clamp, smoothly engages the connectors on the rear of the module to the backplane connectors in the tray. Extraction of the control modules from the tray is similarly enhanced.

Unlike the prior art wherein control modules for a dimmer rack provide actual power control for each dimmer module in the rack, the control modules in the present invention receive industry standard dimming control protocol data input, LAN communications input, remote hand-held terminal data and rack mounted hand-held terminal data which is converted to level information and provided to the dimmer modules in the rack as serial communications data. Communications with the control modules by the individual dimmer modules allow sensing of dimmer module presence in the various slots in the rack by the control module, determination of the dimmer module type in each slot and settings for panic activation of the modules. Dimmer module configuration of the rack and looks which may be invoked directly by the rack without external control are stored in the NVR mounted to the control module tray backplane. The control modules communicate with the NVR and rack. In the embodiment shown in the drawings, the NVR is a serial memory device 300 employing standard protocol two wire interface 308 for clock and data communication with the control modules. Setup using a personal computer can be accomplished through the serial port on the face plate of the control module. Once a rack configuration and rack invoked looks are stored in the NVR, removal of the control modules for repair or replacement will not affect the information present in the NVR. Consequently, racks can be preprogrammed to a pre-wired configuration of the rack prior to shipment and dimmer modules and control modules may be removed from the rack and shipped separately without loss of the stored information. In addition, the prior art requirement for custom control modules for each configuration is eliminated. Reconfiguration of the rack can be accomplished and new data stored in the NVR with at least one control module present in the control module tray. Such reprogramming may be accomplished through the hand held controller mounted in the rack or a personal computer connected to the serial communications port of the control module.

Figure 4:
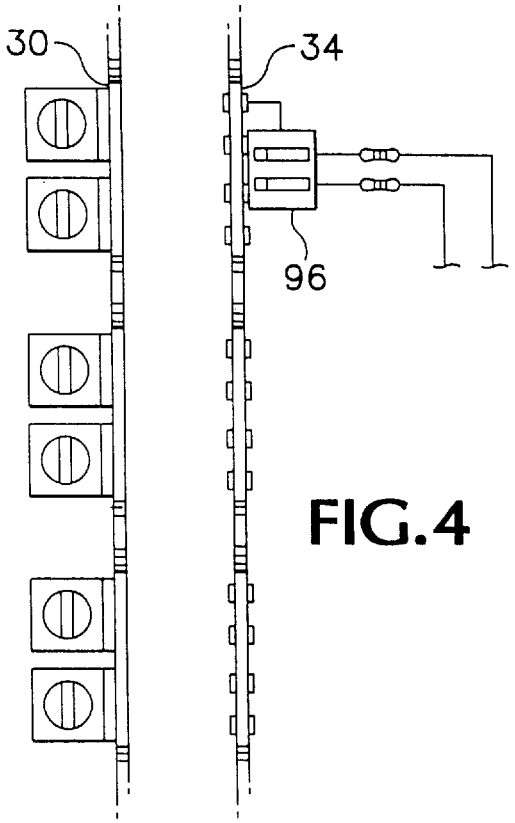
FIG. 4 is a detailed view of the panic switch arrangement.
Figure 5B:
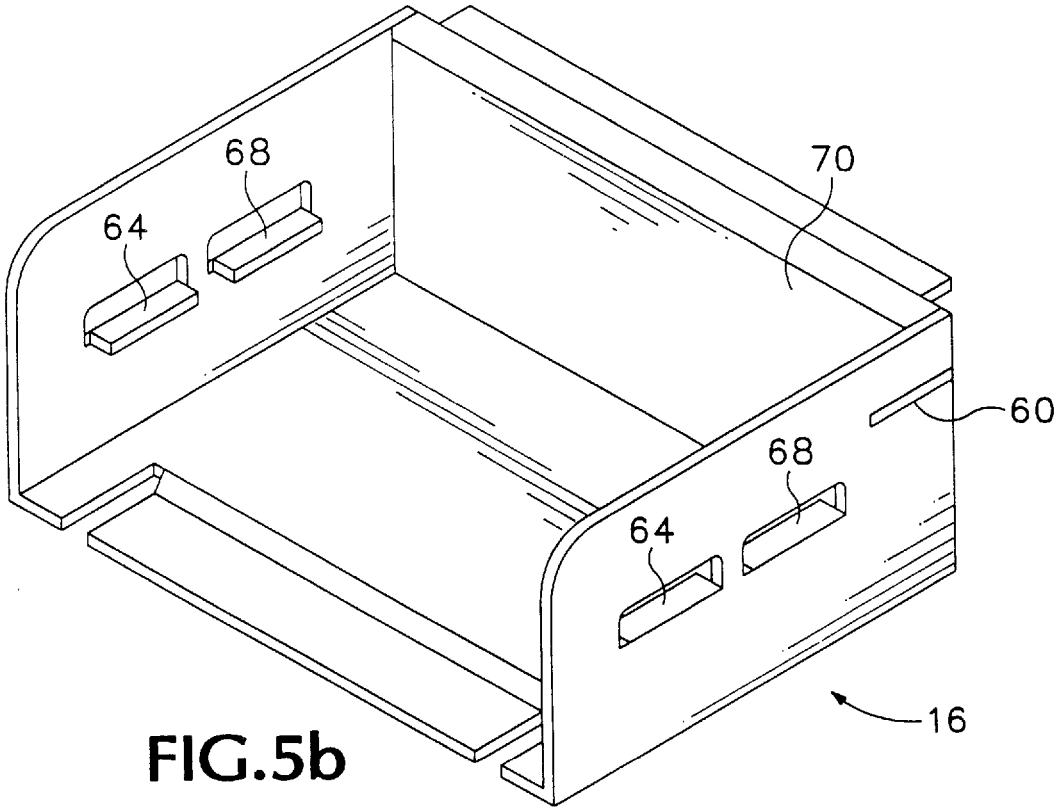
FIG. 5*b* is a perspective view of the control module tray with the modules removed.
Figure 5A:
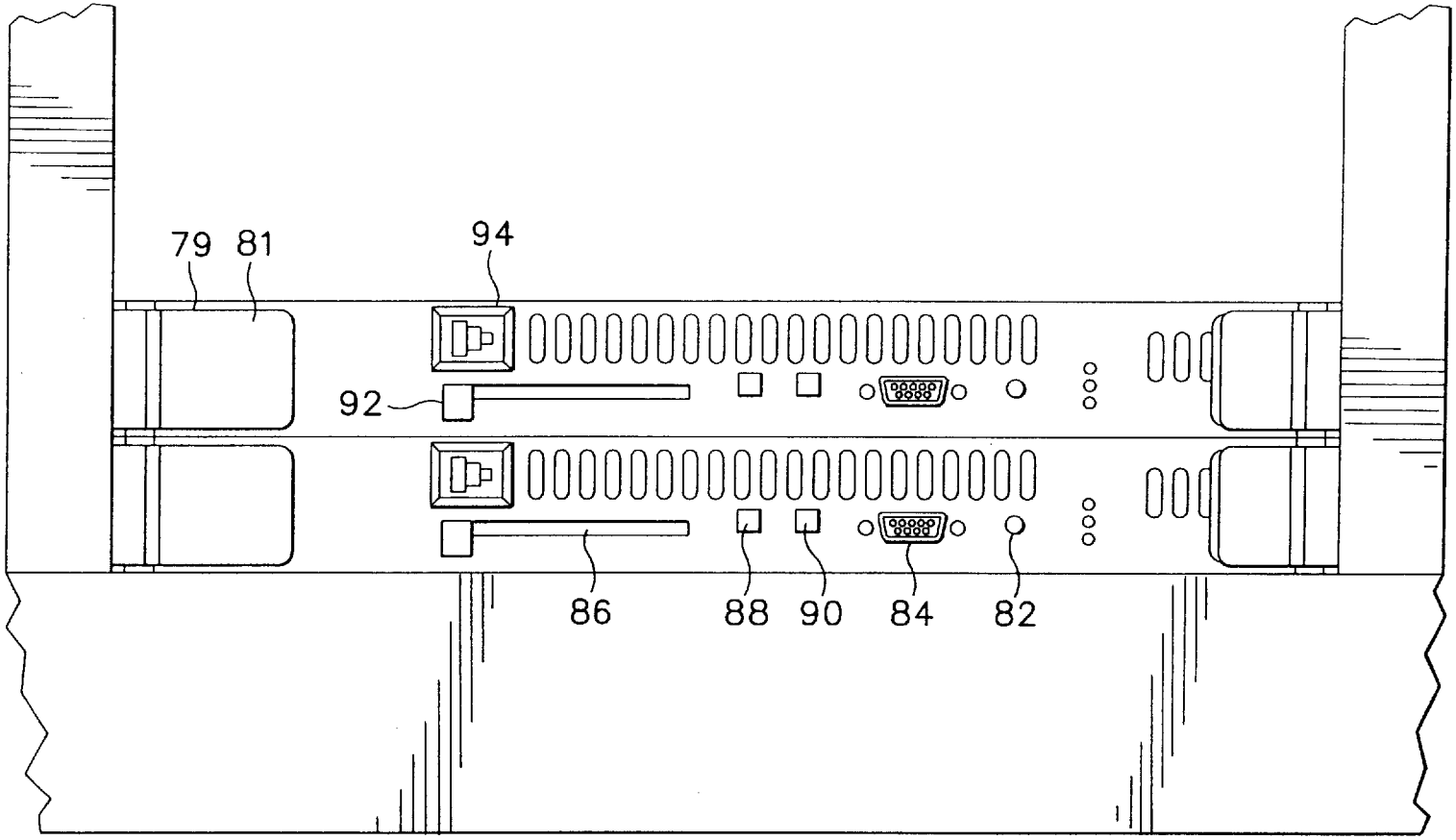
FIG. 5*a* is a detailed view of the control modules in the rack.
Figure 6:
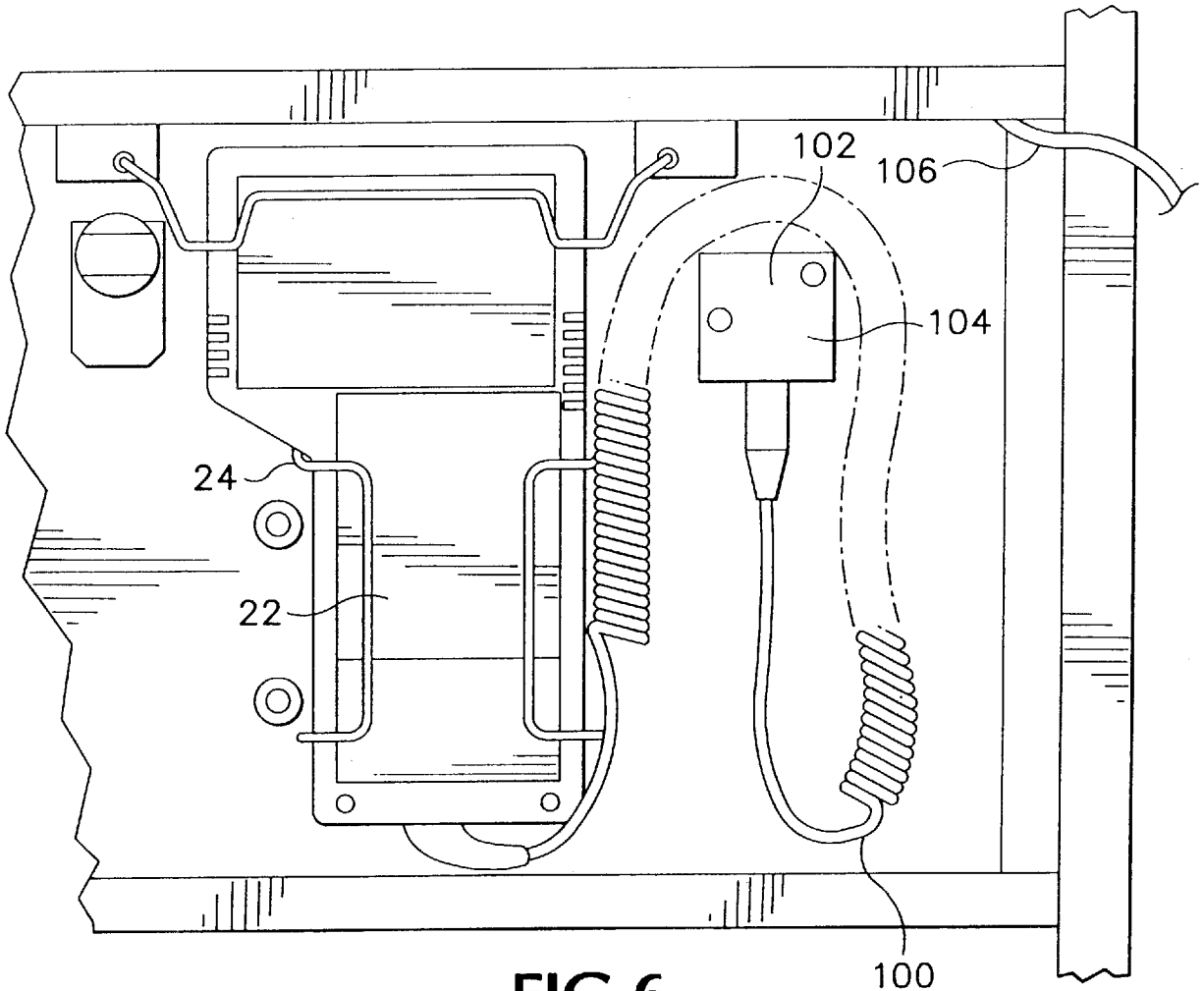
FIG. 6 is a detailed view of the door installation for the hand held controller.
Figure 7:
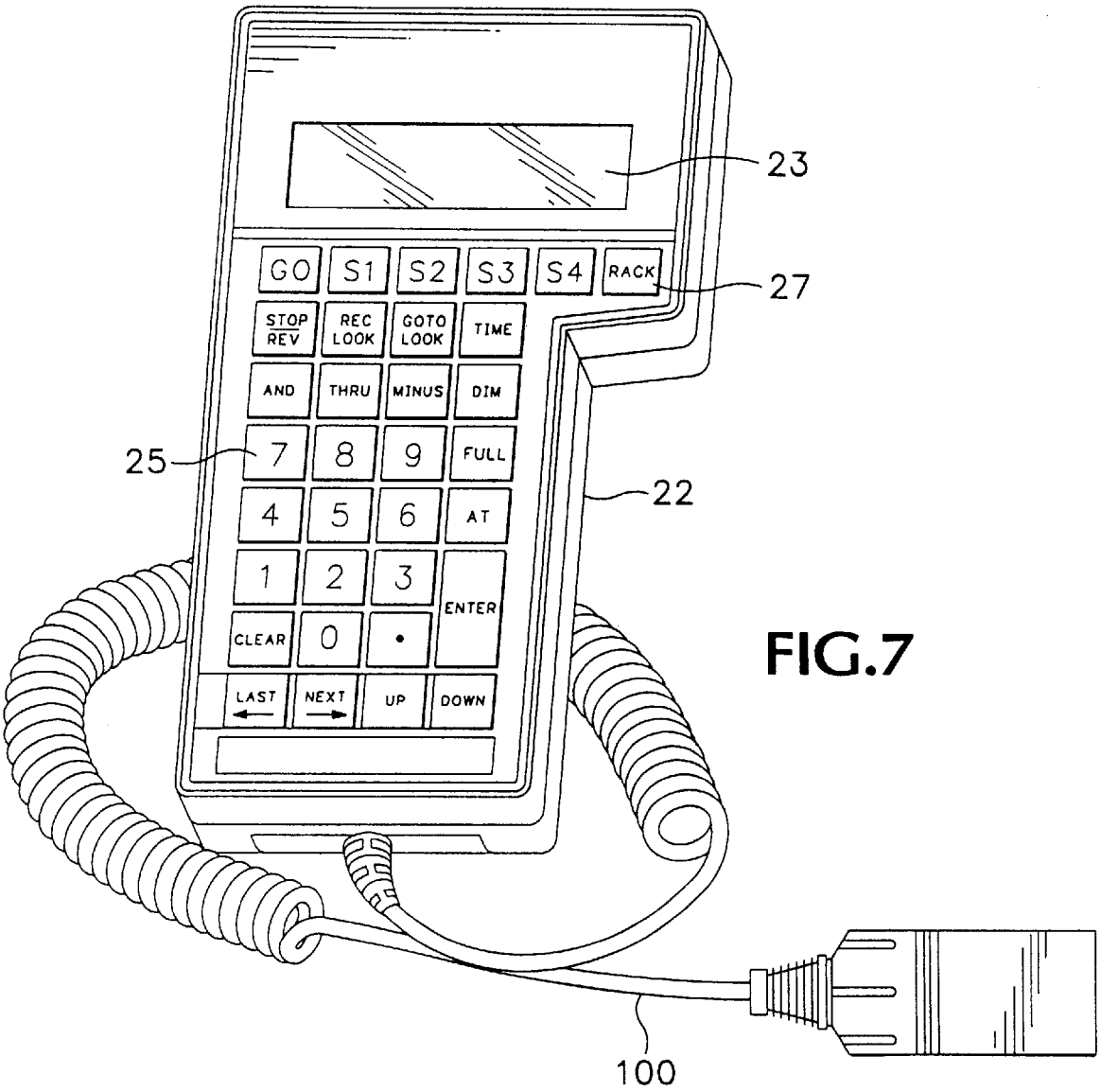
FIG. 7 is a detailed view of the hand held controller.
Figure 8:
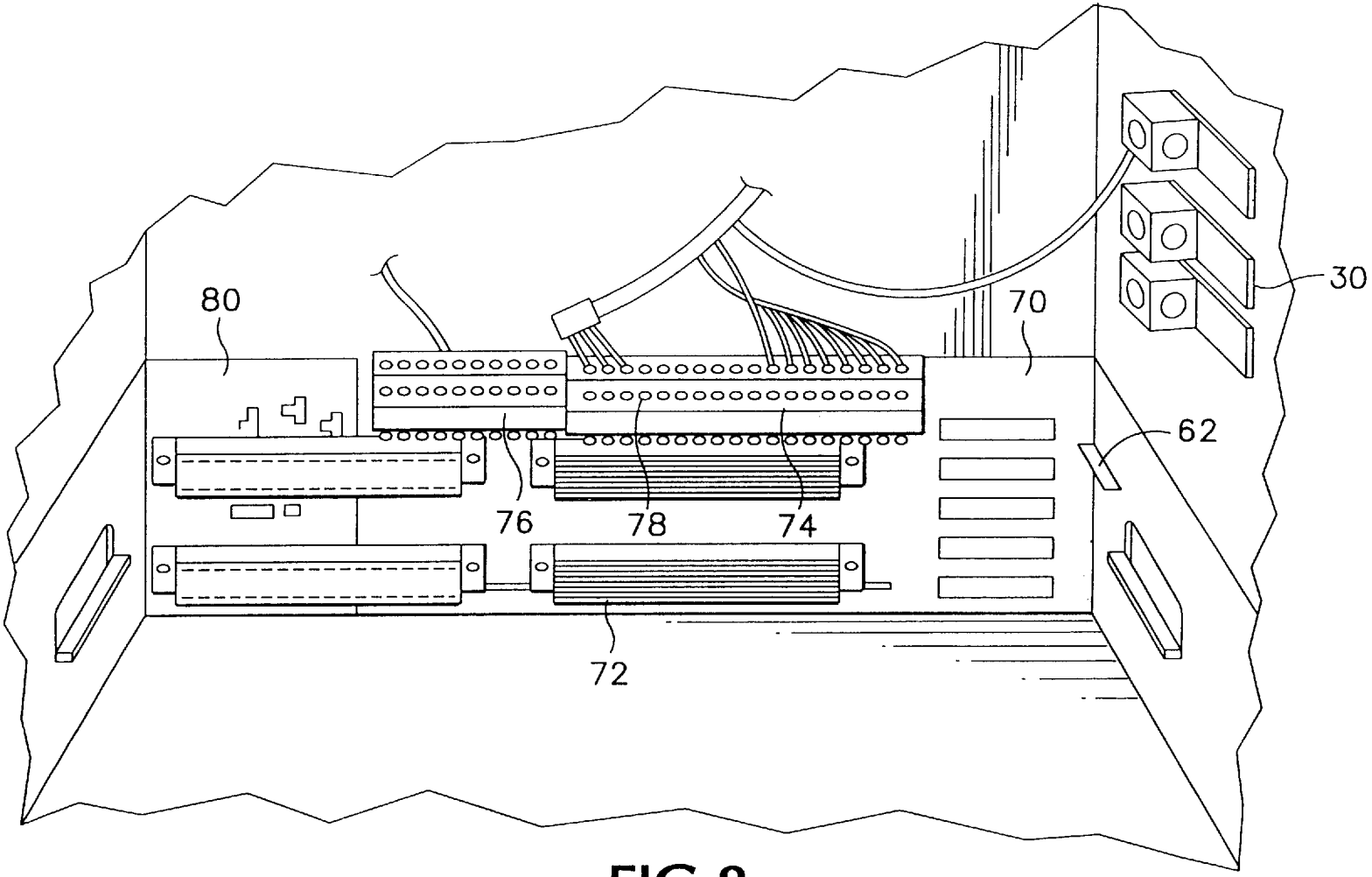
FIG. 8 is a detailed view of the industry standard dimming control protocol and network connection to the rack backplane and non-volatile RAM connection.

The dimmer rack provides for panic mode operation through panic switches 96 mounted to the control signal cards 34 as best seen in FIG. 4. The panic switches provide two DIP switches to accommodate two load dimmer modules. For slots employing a single load dimmer module, only one of the DIP switches is active and for alternative configurations wherein quad dimmer modules supporting four loads per module are employed a ganged three or four DIP switch unit replaces the two switch unit shown in the embodiment of the drawings. The panic switches determine which dimmers will turn on when the rack is placed into panic mode by operation of momentary or latched panic switches mounted external to the rack and wired to the panic terminal inputs 76 on the control module tray backplane. Distributed control of panic designations for the individual modules allows operation of panic mode in the dimmer rack even with the control modules removed or inoperative.

Operation of a panic station external to the rack places the rack in panic mode. Dimmers with panic switches placed in the on position are energized while any dimmer for which the panic DIP switch is set to off will not be turned on but will maintain its level at the time the rack is placed in panic mode. Panic mode overrides normal communications in the rack and any dimmer control inputs are ignored. Panic/dimmer levels are held until the rack is taken out of panic mode.

In addition to panic mode operation of the rack, association of panic switches with individual dimmer modules allows for temporary site lighting with control modules not installed in the rack. Panic switches set to "on" for the appropriate dimmers with activation of the circuit breakers on the dimmer modules for those dimmers will provide power to loads connected to those dimmers as long as the control modules are not installed. Lights associated with those dimmer modules will remain on.

Local control of the dimmer rack is accomplished through a dedicated hand-held controller 22. The hand-held controller is supported by a wire carrier 24 mounted on the interior of the door for the rack. As previously described, a viewing window 20 is provided to allow alignment of the display on the hand-held controller in the rack with the window for viewing of the display with the door of the rack closed. The standard hand-held controller cable connection 100 is supported by routing brackets 102 mounted on the door interior and connected to a connector converter block 104. The connector converter provides an extension cable 106 prewired into the door structure to connect the hand-held controller to the control module. The extension cable terminates in a multiconductor connector 108 for connection to the mating connector 94 on the front panel of the "in use" control module. Mounting of the hand-held controller and its associated cabling as described allows proper airflow to be maintained in the dimmer rack to the dimmer module slots.

The handheld controller incorporates a display and numeric keypad and special function keys for data entry for dimmer module level control, development, storage and recall of looks comprising multiple dimmers, and rack configuration, and monitoring of rack and dimmer status. For systems employing multiple racks, the handheld controller in one rack is employed for control of all racks connected as nodes in a local area network as will be described in greater detail subsequently.

Dimmer modules designed in accordance with the present invention employ single, dual or quad dimmer configurations. The embodiments shown in the drawings demonstrate a dual dimmer configuration while a quad dimmer configuration is disclosed in co-pending patent application Ser. No. 08/588,393, attorney case docket number C149:28115, having a common assignee with the present application.

Figure 9A:
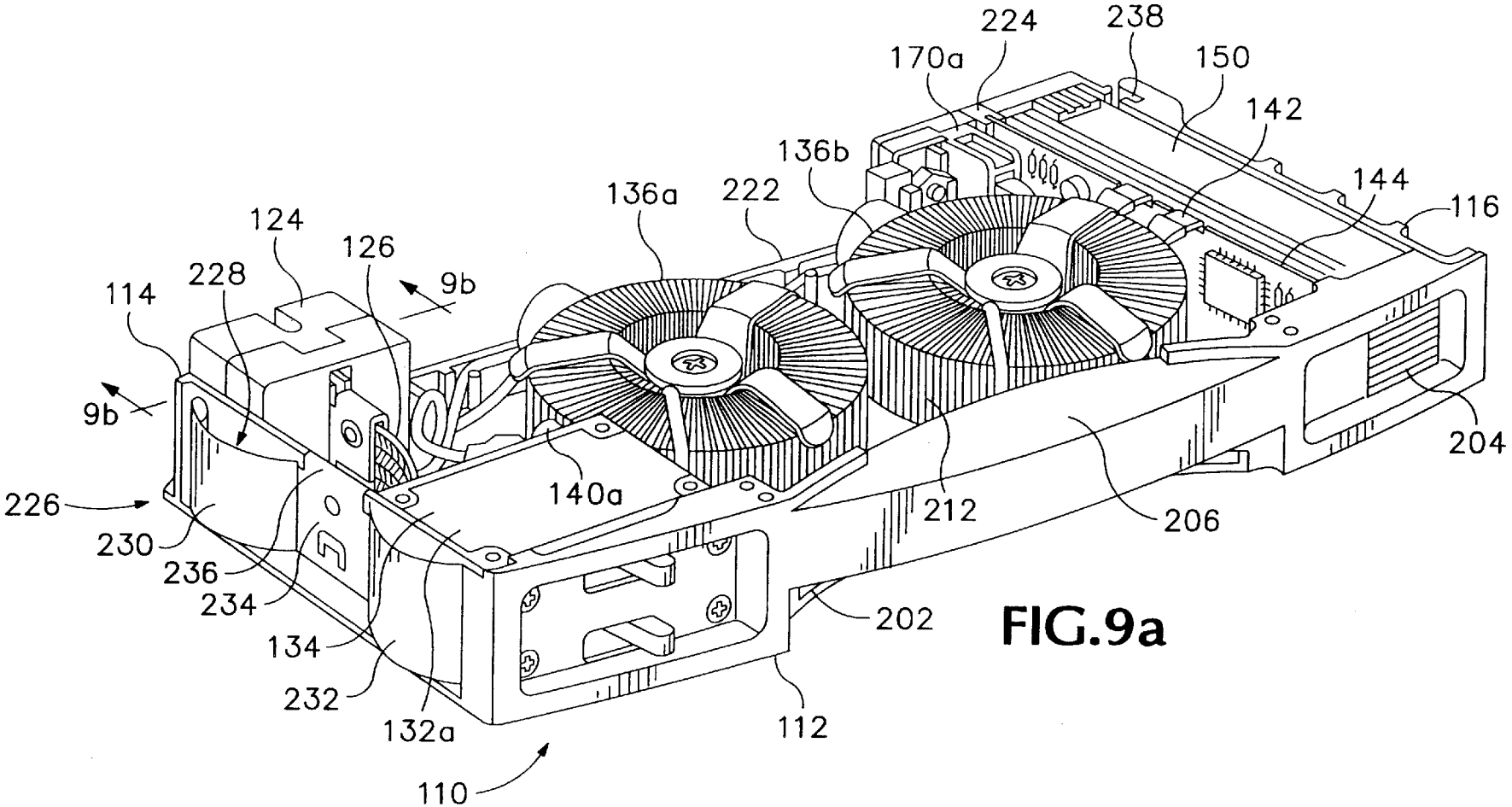
FIG. 9*a* is a perspective top view of one configuration of a dual dimmer module according to the present invention.
Figure 9B:
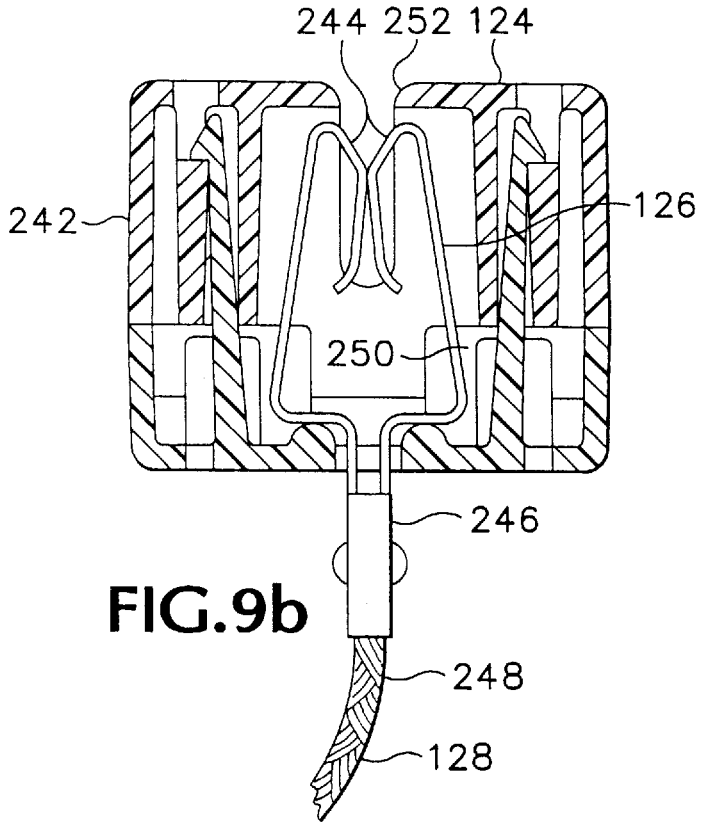
FIG. 9*b* is a sectional view of the power connector for the dimmer module of FIG. 9*a;*

The physical design of a dimmer module according to the present invention is illustrated in FIGS. 9*a* and 9*b*. The dimmer module 110 comprises a chassis 112 formed, in the embodiment shown, from die-cast aluminum. The chassis incorporates a left side wall 114, a right side wall 116 and a face plate 118.

As depicted in FIG. 9*a* the dimmer module is capable of controlling two separate lighting fixtures or two groups of interconnected fixtures. Input power is received by the module through connector 124 located adjacent the left wall of the chassis. A floating contact 126 is incorporated in the power connector to accommodate tolerance buildup in mating the connector module to dimmer racks. The floating contact includes an extended conductor 128. Two circuit breakers 132*a* and 132*b* control the input power for the two loads of the dimmer module. Breakers 132*a* and 132*b* are mounted in a stack 134 attached to the face plate of the chassis.

Two inductors 136*a* and 136*b* comprising toroidal chokes for current supply in the dimming control circuits are mounted in the chassis. Input power is provided from the conductor extension to the line contacts 138*a* and 138*b* of the circuit breakers as best shown in FIG. 9*a*. Vertical interconnection of the breakers in the stack is accomplished, in the embodiment shown in the drawings, through a standard bus bar arrangement. Power is routed from the load contacts 140*a* and 140*b* of the circuit breaker stack to the inputs of inductors 136*a* and 136*b* respectively.

Figure 10A:
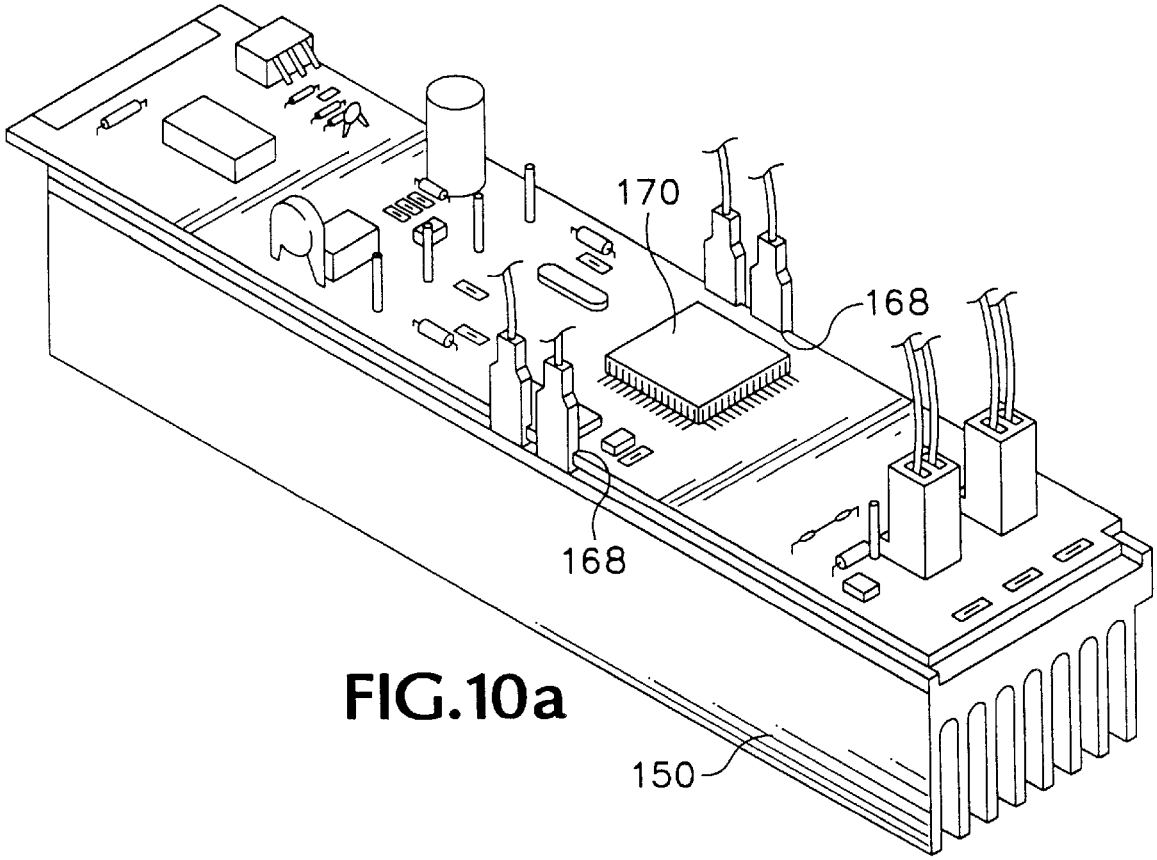
FIG. 10*a* is a detailed view of the top board arrangement for the power device and micro-controller of the module.
Figure 10B:
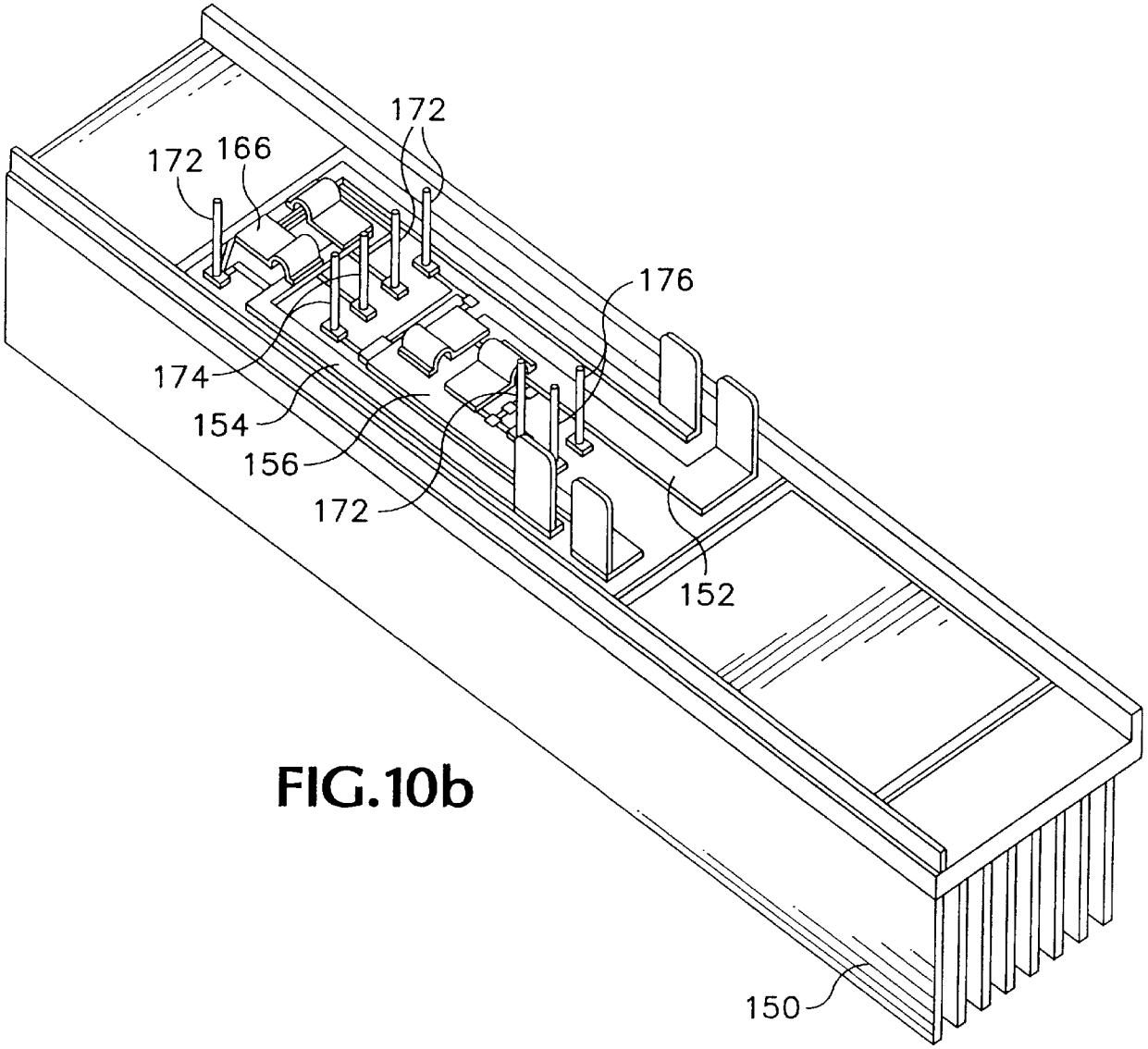
FIG. 10*b* is a detailed view of the SCR board arrangement for the power device of the module.

A power device generally designated 142 is mounted in the chassis adjacent the right wall. The power device comprises a top board 144 which incorporates control circuitry for the dimmer module, and printed circuit substrate 146 which is mounted to a finned heat sink 150 as best seen in FIG. 10. The substrate carries two dimmer circuits 310, each circuit designed to control the power to a single lighting fixture or group of fixtures. Input lead frames 151 and 152 and output lead frames 154 and 156 are mounted to the substrate. SCRs generally designated 166 are surface mounted on the lead frames and cross strapped in an anti-parallel circuit relation in a conventional manner. Power control for two dimming circuits is provided through SCRs mounted on the substrate.

Each of the lead frames terminates in a blade connector perpendicular to the surface of the substrate and located proximate the edge of the substrate. The connectors on the lead frames extend through edge cutouts 168 in the top board for electrical connection as best seen in FIG. 10. As shown in FIG. 9*a*, the outputs of inductors 136*a* and 136*b* are connected to lead frames 150 and 152 respectively. Output lead frames 154 and 156 are connected to load connectors 170*a* and 170*b* mounted in the rear of the chassis intermediate the plenum vent 214 and power device exhaust aperture 222.

Extension of the lead frame connectors through the edges of the top board eliminates perforations in the top board required for such connections. The top board therefore provides a substantially solid baffle to assist in air flow control for cooling of the power device and allows greater flexibility in design and routing of circuit traces on the top board.

Control of the SCRs in the power device is accomplished by a microcontroller 170 and conventional circuitry using gate connections generally designated 172 and voltage sense connections generally designated 174 in FIG. 10. In the embodiment shown, a Hitachi H8/326 device is used for the microcontroller. A thermistor mounted to the SCR substrate and connected to the top board through connection 176 allows temperature monitoring of the power device by the microcontroller. This allows for both warning and shutdown modes under microcontroller control for each individual dimmer module. Communicating by the microcontroller is accomplished through connector 224 located in the rear wall of the module adjacent the load connector which receives the board connector in the rack upon insertion of the dimmer modules into a slot.

The dimmer module of the present invention is designed for use in the dimmer rack employing cooling fans drawing air through the dimmers into the common cooling flow chamber internal to the rack as previously described.

As best seen in FIG. 9*a* the face plate of the chassis incorporates a central cooling aperture 202 and a right cooling aperture 204. The central cooling aperture is horizontally bifurcated by a vane 206. Air flowing from the central aperture enters a plenum 212 and exits through a rear vent 222. The inductors carried within the chassis are arranged in the plenum.

Cooling air for the power device is provided through the right aperture in the front plate of the chassis and is directed over the fins of heat sink 150 and exits the chassis through an exhaust aperture in the rear wall adjacent the right chassis wall.

The arrangement of the dimmer module compensates for tolerance accumulation in fabrication of the device and the dimmer rack. The right hand wall of the dimmer module and the interior panel for the right hand wall of the rack constitute the datum for dimensioning. The left hand wall of the dimmer module incorporates a slot arrangement 226 which receives a side load spring 228. In the embodiment shown in the drawings the side load spring comprises two lobes 230 and 232 connected by a web 234 which incorporates a formed clip 236 received over the top edge of the left wall of the dimmer module chassis substantially centered in the slot arrangement to secure the spring to the chassis. The lobes of the side load spring flex to engage the left hand interior panel in the dimmer rack intermediate the guides for each slot urging the entire chassis to the right thereby firmly engaging the right chassis wall with the right interior panel of the dimmer rack. This allows high accuracy in placement and dimensioning of the control signal connector 34 and the mating connector on the dimmer module 224 due to their close proximity to the datum. Performance of the invention is thereby enhanced since the control signal connector 34 may employ standard printed circuit board edge connector technology without concern over highly accurate dimensional control of the dimmer module engagement in the dimmer rack slot.

Similarly, the load connectors may employ substantially lower tolerance contacts based on placement proximate the datum.

Figure 3B:
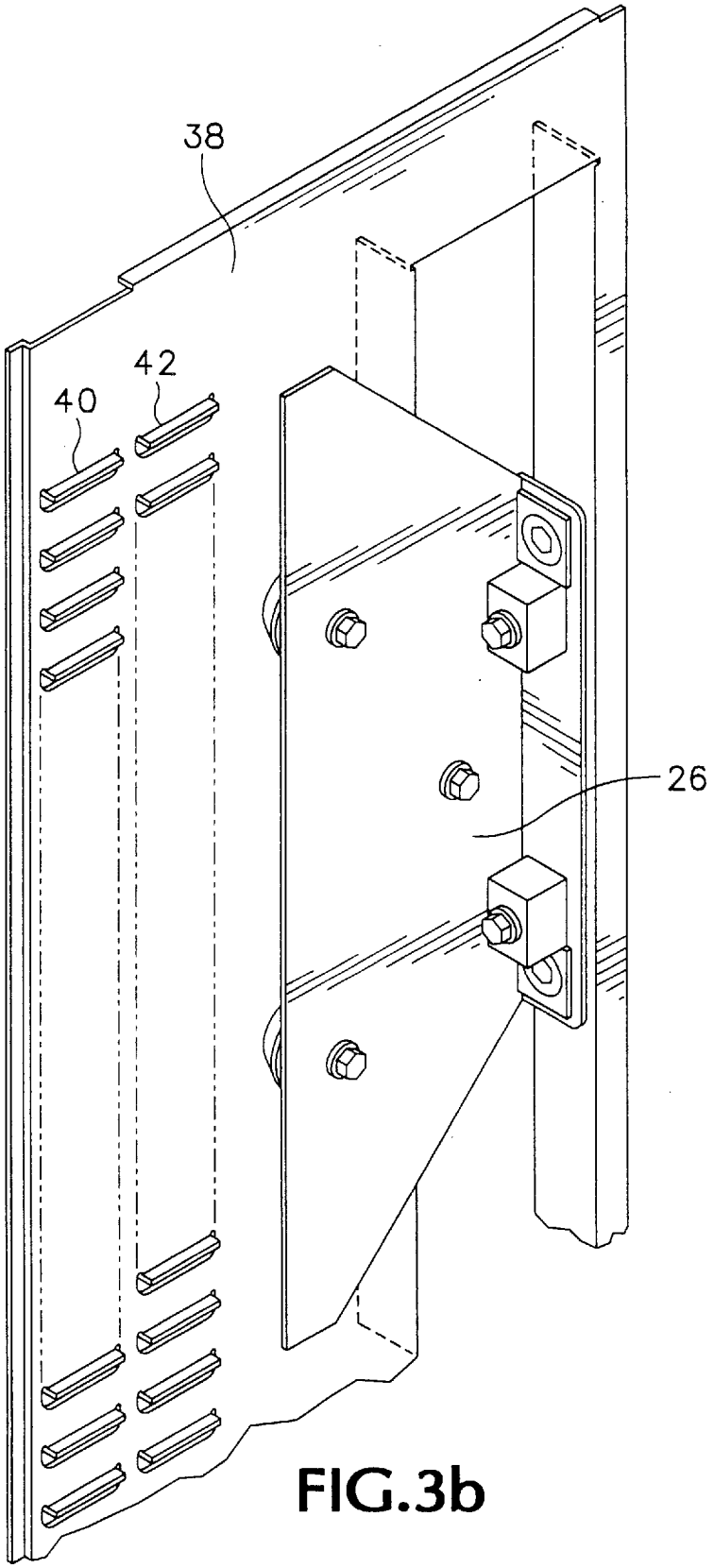
FIG. 3*b* is a detailed perspective view of a portion of the rack of FIG. 2*a* showing the dimmer module support structure and power bus.
Figure 3C:
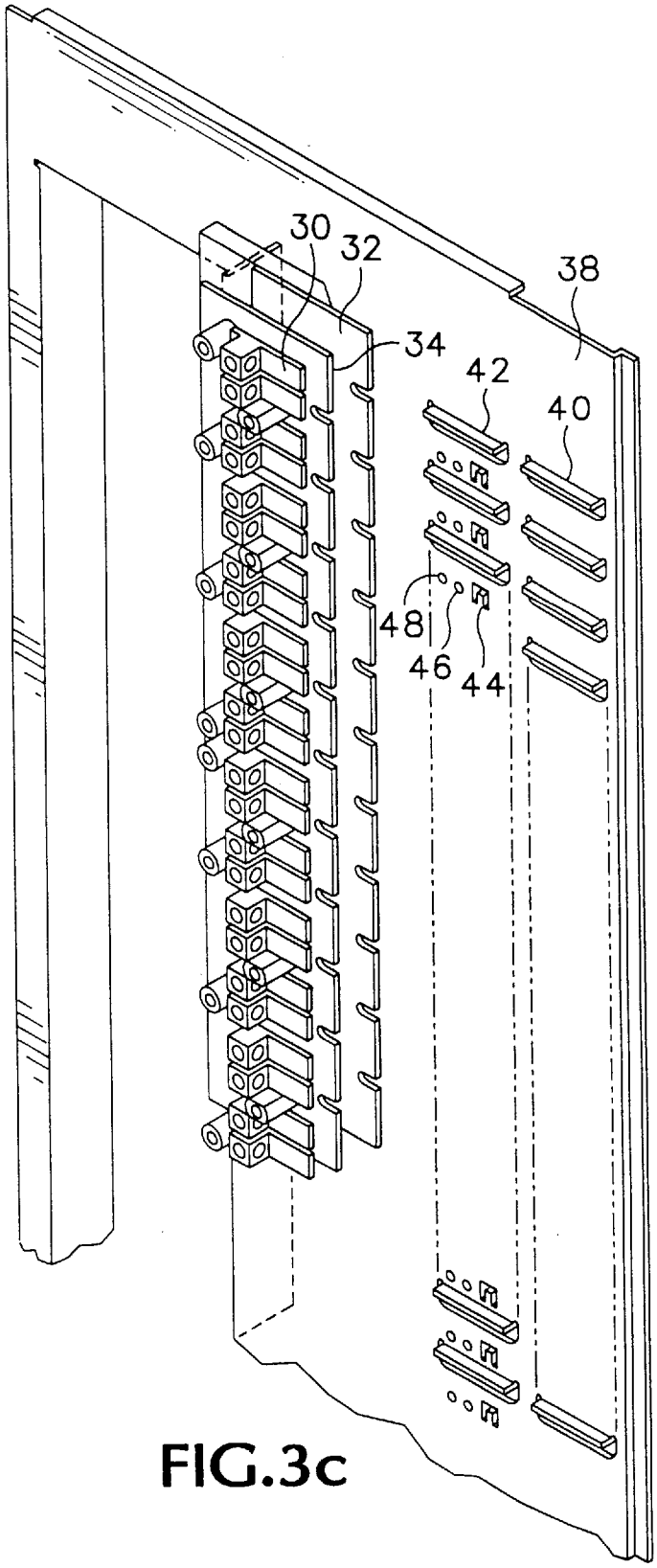
FIG. 3*c* is a perspective detailed view of a portion of FIG. 3*a* showing the load connections, control signal connections and a module support structure with module type keying.
Figure 3D:
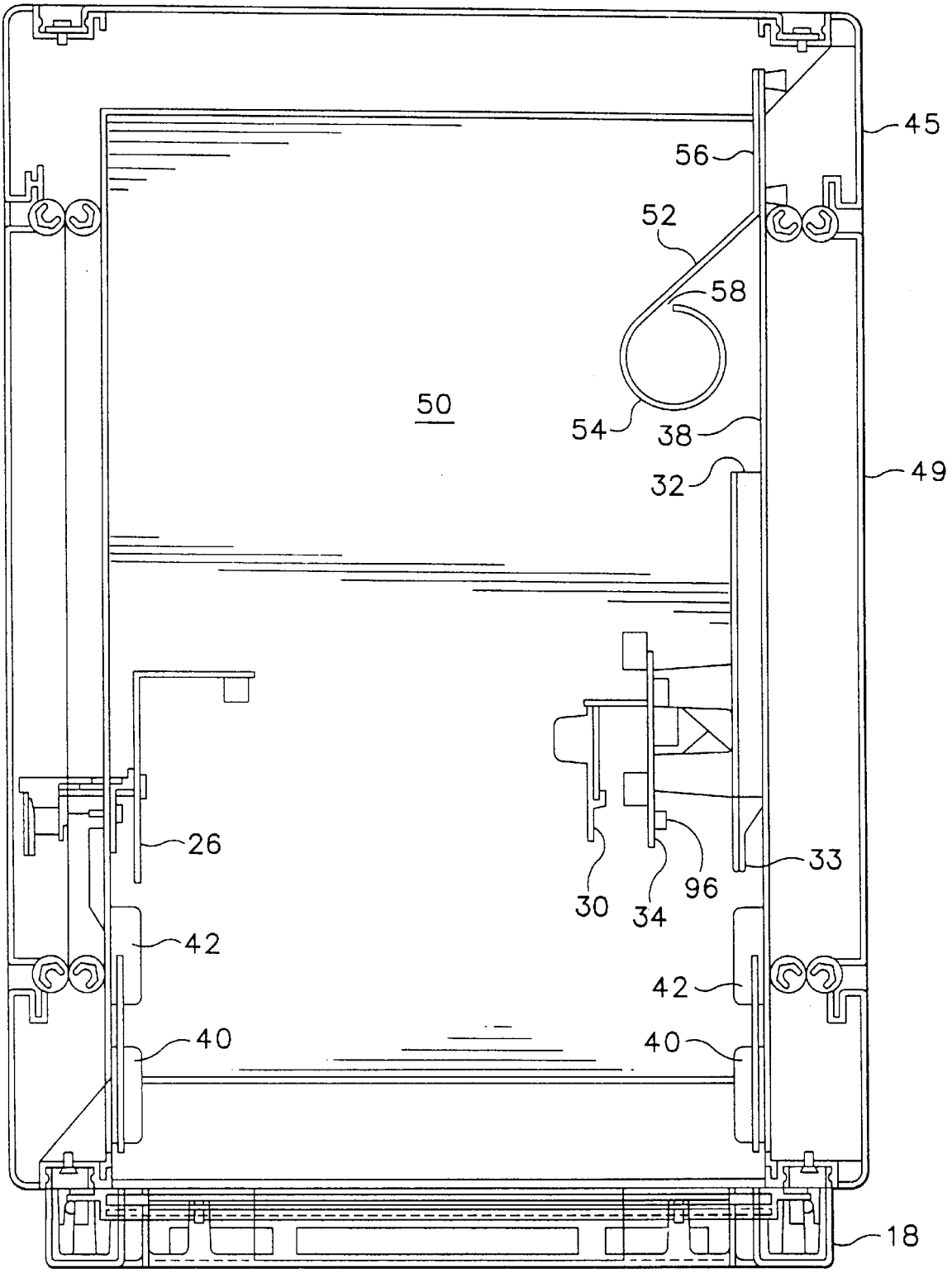
FIG. 3*d* is a sectional top view of the dimmer rack.

A probe 33 extending from the main insulator as best seen in FIG. 3*d* is received in slot 238 in the chassis to prevent displacement of the chassis to "jump" the configuration tabs.

The power connector for the dimmer module is specially designed according to the invention, as shown in the embodiment presented in the drawings, to provide a floating contact 126 received in the housing 242 of the power connector. The floating contact comprises two spring contacts 244 engaging one another in connection tangs 246 which are mated employing a standard rivet or other compressive mounting technology or welding the contacts and braid. A conductor braid 248 is engaged between the connection tangs and similarly secured by the rivet. The floating contacts are constrained within the connector case by engagement slots 250. Lateral motion is therefore possible by the floating contact to engage the blade of the power bus 26 which is received in slot 252 in the connector. Slot 252 is oversized in lateral dimension sufficient to accommodate any tolerance buildup in the dimmer module construction. The flexible braid allows lateral motion of the floating connector and is connected opposite the floating contacts for electrical attachment to the circuit breakers in the dimmer module.

In addition to providing lateral positioning of the dimmer module, the side load spring masks the left hand interface of the dimmer module with the dimmer rack to preclude airflow through the slot exterior to the dimmer module. Additionally, the side load spring provides the ground contact with the dimmer rack for the dimmer module providing a common chassis ground.

A distributed processing capability of the dimmer modules according to the present invention is accomplished through incorporation of a microprocessor 170 on the top board of the power device. Communications between the microprocessors of the dimmer modules and the control module is accomplished using standard serial communication. The control connector for the dimmer module employs four contacts comprising power neutral, panic line input which will be described in greater detail subsequently, logic common and the bi-directional communication line 312. Use of the distributed processing capability of the present invention allows a reduction over prior art systems in the number of control connections required for the dimmer module.

The panic line contact of the control connection communicates with the panic switch circuit associated with each dimmer module slot. As previously described the panic switch comprises DIP switches mounted to the control card. The panic switch circuit comprises three resistors connected in series through the poles of the DIP switches whereby the various switch positions provides one of three distinct voltages on the panic contact for sensing by the microcontroller. A zero level read by the microcontroller would constitute no panic activation of either dimmer load in the module. The first voltage reading would signal activation of the first load with no activation of the second load in panic mode. The second voltage level would indicate activation of the second dimmer load with no activation of the first dimmer load during panic mode, while the third voltage level would indicate activation of both dimmer loads when panic mode is invoked. Individual sensing of the panic line by the microcontroller on each dimmer module allows independent operation of the dimmer module when panic mode is invoked regardless of the presence or state of the control module in the rack as previously described.

The decentralized processing capability of the dimmer modules allows individual dimmer control, diagnostics and recalibration capabilities not previously possible in the prior art wherein control activities were centralized in a control module or similar arrangement. Features of the present invention enabled through this distributed processing include dimmer module presence detection and type identification, load current sensing, open load sensing, circuit breaker open sensing, increased accuracy power control through zero crossing prediction with separate counting of positive and negative wave phases to accommodate non-symmetrical wave forms regardless of the phase employed to power the dimmer and direct power down for individual dimmer modules based on onboard temperature sensing.

Figure 12:
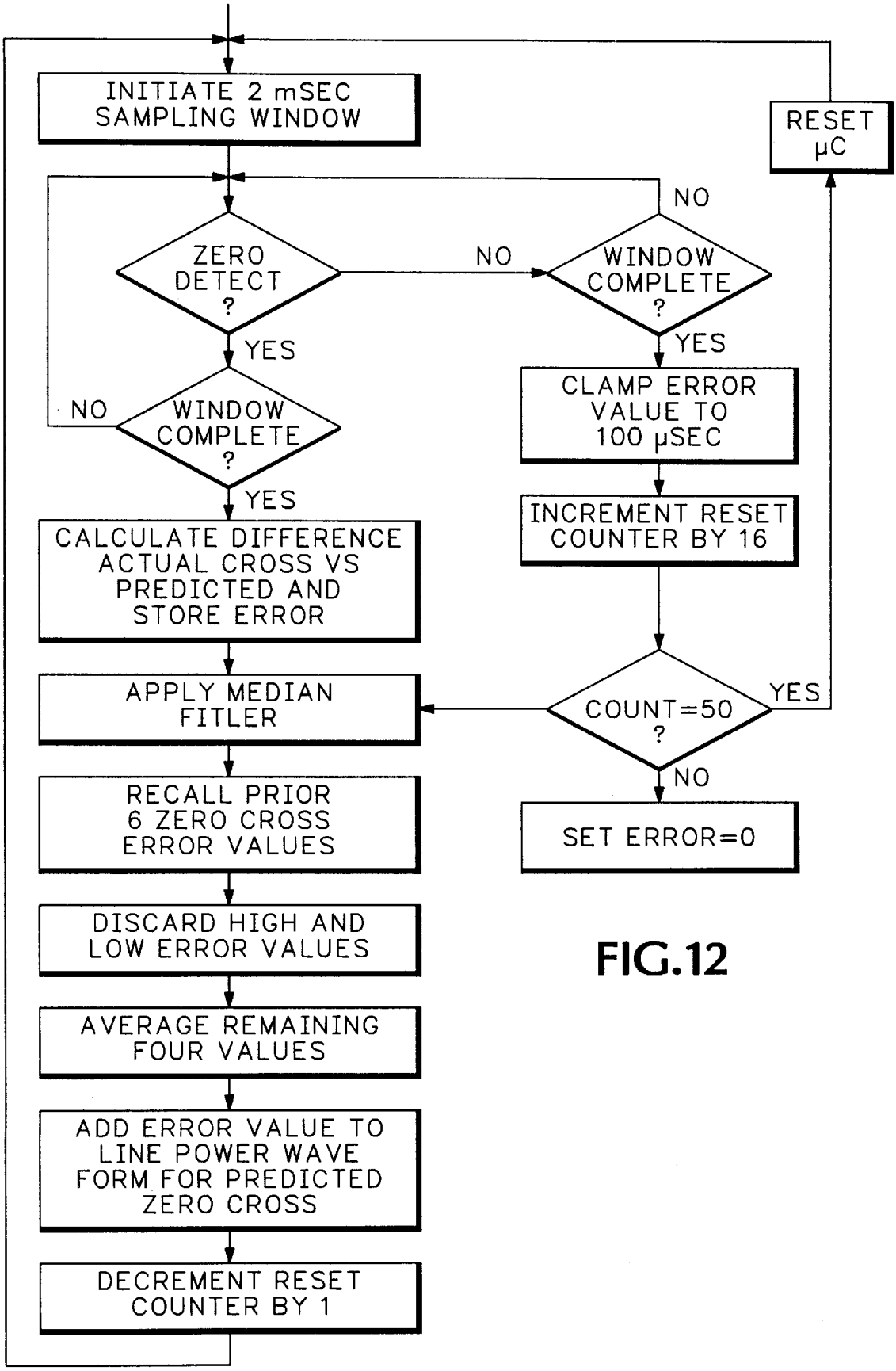
FIG. 12 is a block diagram demonstrating operation of the micro-controller in phase voltage zero cross detection.

The zero cross detection feature of the present invention is disclosed in FIG. 12. An error value is calculated for each rising or fall edge zero crossing for the power input to the dimmer module. The error value calculated is the difference between actual zero crossing and the predicted zero crossing. The actual zero crossing is defined as the last zero crossing within a two millisecond sampling window since multiple zero crossings due to power distortion or ripple may be present. The predicted zero crossing is calculated by applying a median filter to the previous six error values, discarding the highest and lowest value and averaging the remaining four values and adding the error (positive or negative) to the period of the line power wave form. The next zero crossing is then predicted based on the stored history of prior zero crossings.

If no zero crossing is detected within the sampling window due to momentary power drop out or other sampling failure, the calculated error is clamped to 100 usec. If no zero crossing is detected within the two millisecond window then the error value for the window is set to zero and a running counter is incremented by 16. If a zero crossing is detected within a window then the running counter is decremented by one. If the running counter reaches 50 then the microcontroller is reset to avoid instability.

Measurement of actual power output by the dimmer module is accomplished in the microcontroller using a power measurement device comprising a toroid measuring output current from the inductors and a simple diode, capacitor and bleed resistor circuit. The toroid saturates (operating in a range of 5 volts DC with a saturation level of about 100 millivolts) and by charging and bleeding the capacitor over the sample time produces a DC voltage which is read by the microprocessor. The microprocessor conducts a table look-up to convert the DC voltage reading into a value representative of the power during the sample time. Control of output voltage is accomplished by the microprocessor by serving on the sum of squares of line voltages measured during the time of output power. The servo control level becomes the desired output voltage squared. Line voltage is sampled at a frequency of 10.8 KHz squared and summed during each half cycle. The calculated result is compared to a similar calculation for the desired or ideal line voltage and the difference is fed back in a servo control loop. This feature of the present invention has the advantage of a high sampling rate made possible through the onboard microcontroller to detect actual irregularities in the line power as opposed to using peak or averaging methods typically employed in the prior art. In addition, positive and negative half cycles are controlled separately to optimize processing power of the microprocessor through performance of calculations during the opposite half cycle.

Figure 13A:
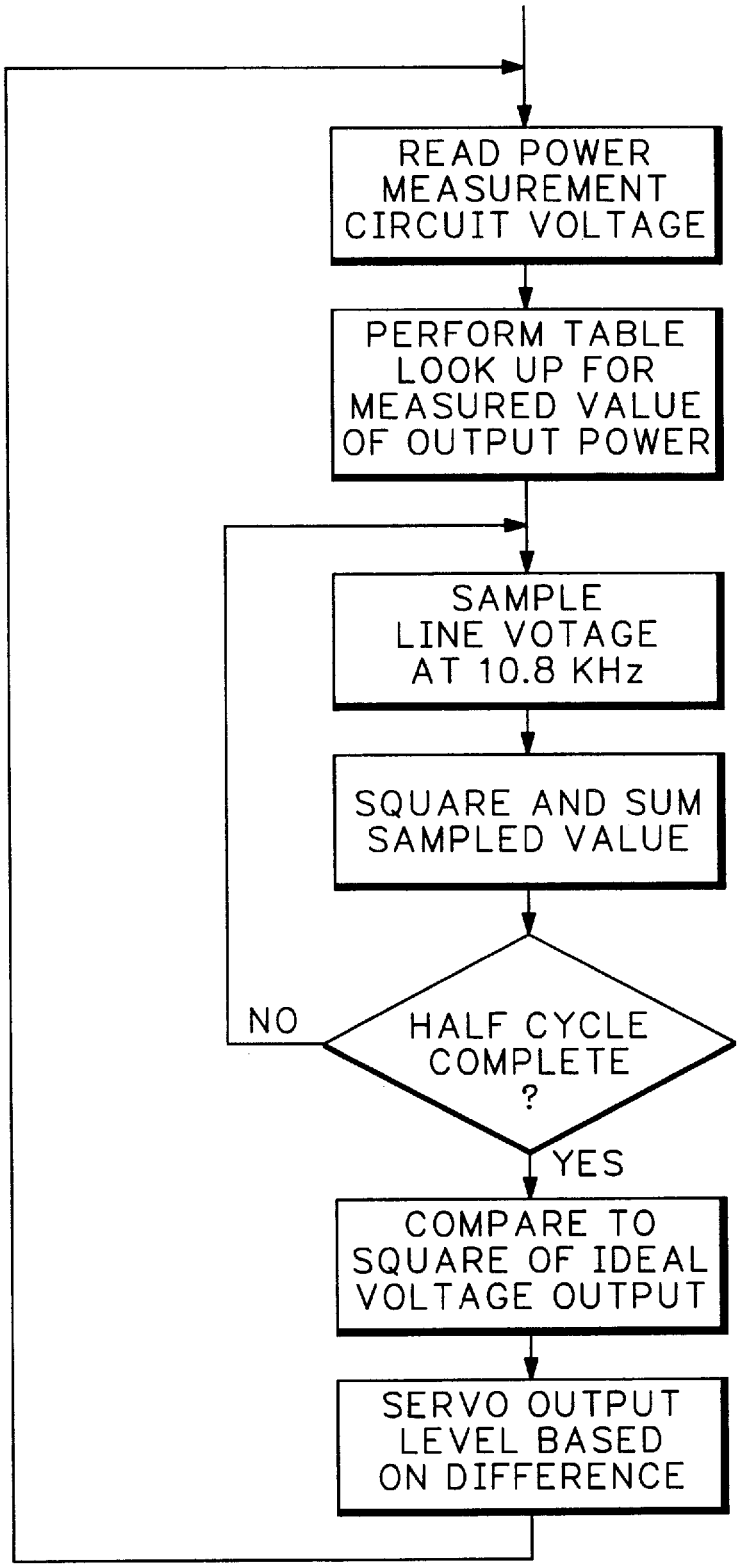
FIG. 13 is a block diagram demonstrating operation of the micro-controller in output voltage control.

The present invention further accommodates the use of electronic noise reduction (ENR) capabilities such as that disclosed in U.S. Pat. No. 5,004,957. The power gated out over two consecutive half waves are summed during the half cycle prior to where the SSR is to be activated. This allows the update rate for power servo correction to be the same rate as in the non-ENR mode, one correction per full wave. Adjustment of the PWM phase control for the SCRs is accomplished using this algorithm as disclosed in FIG. 13*a* and shown schematically with regard to the wave phase in FIGS. 13*b*, 13*c* and 13*d*.

Figure 13B:
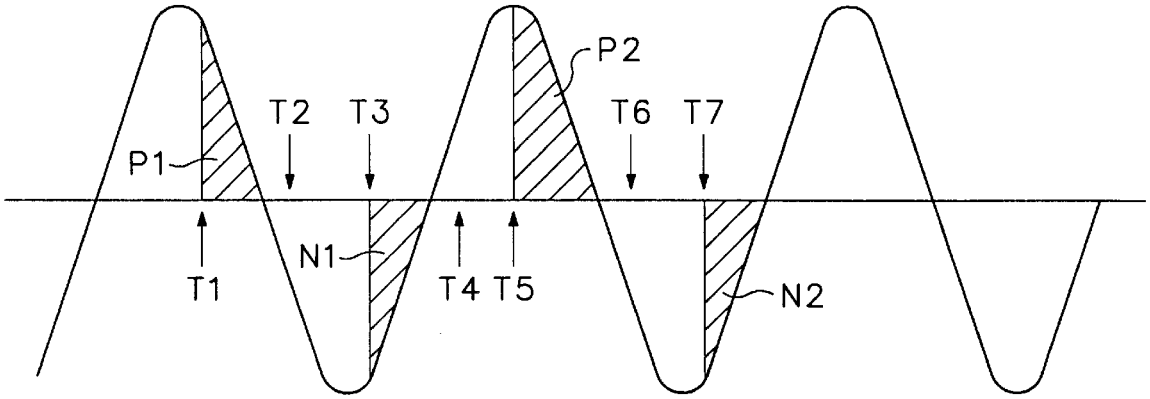

In FIG. 13*b*, a normal non-noise reduced wave form utilization is shown. P1 represents the RMS voltage measured from the time the SSR was turned on T1 until the falling zero cross. The SSR device, once turned on, will latch until the voltage drops to zero. One millisecond following the zero cross T2 the P1 value is compared to the target voltage and a correction is applied to the next positive turn on point T5 in order to control the P2 voltage. N1 represents the RMS voltage measured from the SSR turn on T3 until the rising zero cross. The N1 voltage is compared to the target voltage at time T4 in order to correct the next negative turn on point T7 to control the N2 voltage. In this way corrections are made at the line frequency rate with both positive and negative voltages independently controlled. A DC balanced output is obtained.

Figure 13C:
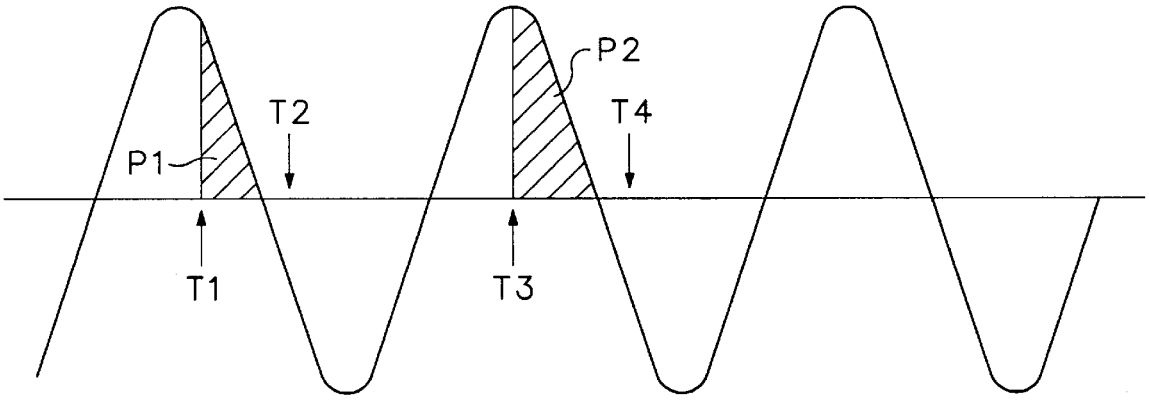
Figure 13D:
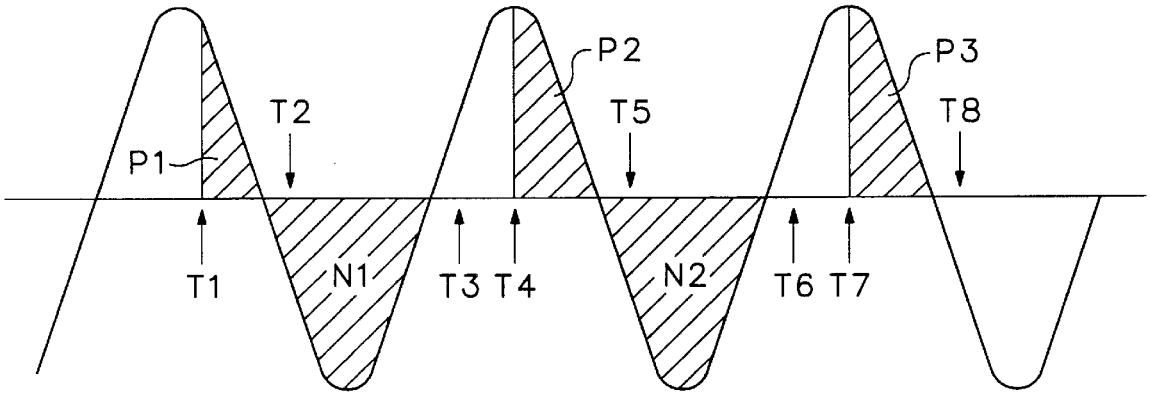
Figure 14:
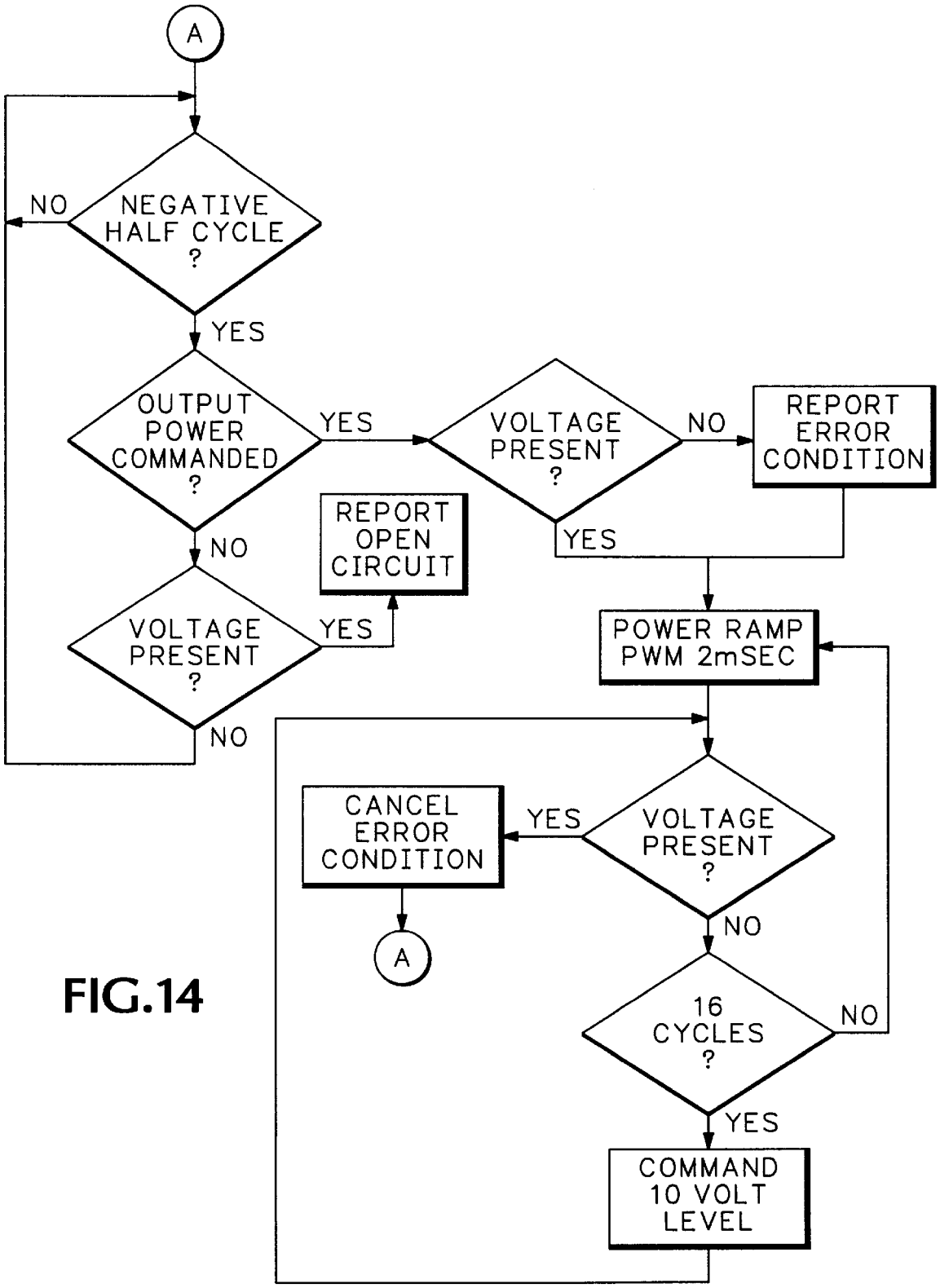
FIG. 14 is a block diagram demonstrating operation of the micro-controller in open circuit and open breaker detection.
Figure 19:
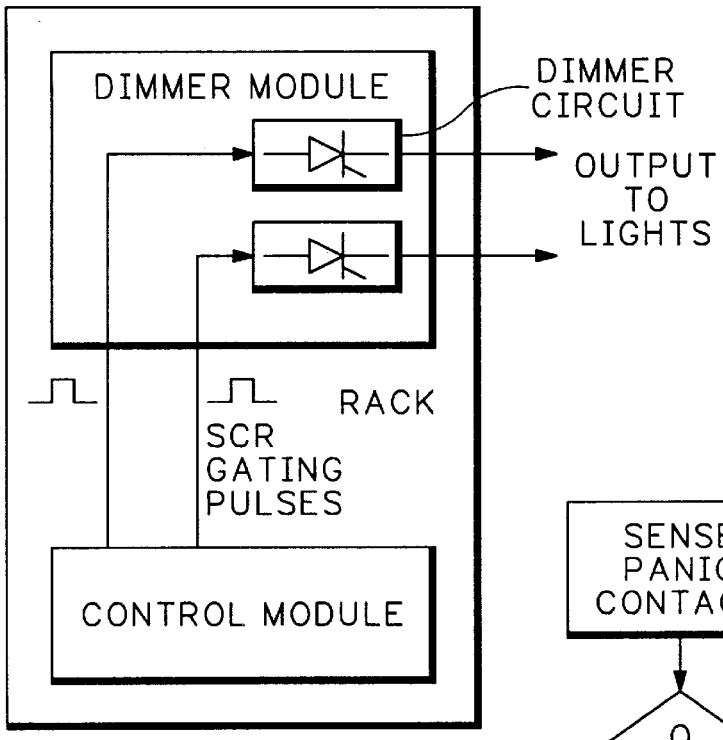
FIG.19 (PRIOR ART)
FIG. 19 is a block diagram of a prior art dimming control system.
Figure 15:
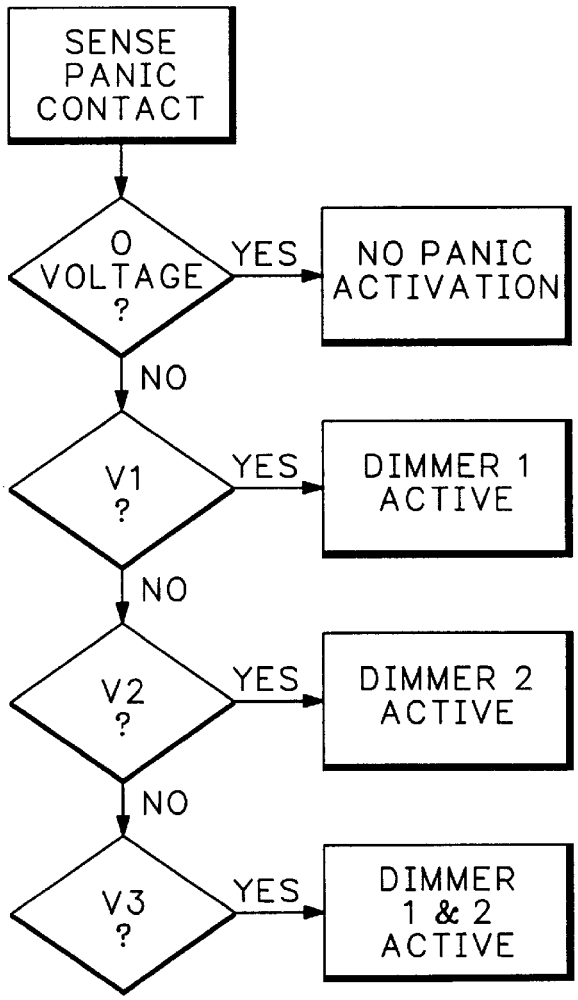
FIG. 15 is a block diagram demonstrating operation of the micro-controller for panic switch detection.

In FIGS. 13*c* and 13*d*, a noise reduce technique is illustrated. In FIG. 13*c*, the waveform shown is one in which less than 50% of the voltage is gated. The voltage P1 is analyzed at time T2 in order to adjust the turn on at T3 to control P2. In FIG. 13*d* a waveform at more than 50% is shown. Picking up at time T3 the N1 voltage is stored for later use. At time T5 the N1 and P2 voltages are summed and compared to the target voltage for correction of turn on time T7. By utilizing the corrections shown in FIGS. 13*c* and *d*, the corrections can be made at the line frequency rate in order to maintain the same regulation performance as in the non-noise reduced method and using the same data and interrupt hooks for the microcontroller.

The microcontroller of the dimmer module in the present invention can detect an open circuit (no load) without commanding output power. During the negative half cycle the dimmer module is a "hot chassis". If no output power is commanded and the SSRs are therefore not enabled "on", a voltage will be present if no load is connected. The microcontroller senses voltage at the peak of the negative half-cycle and if a voltage is absent the open circuit condition is reported by the microcontroller.

Similarly, if the commanded dimmer level is not zero and no output voltage is detected then either the circuit breaker is open or there is a cold load or short on the output. In each of these cases, a no output voltage error condition is reported by the microcontroller and the SSR is inhibited if the condition continues to exist over 16 power cycles, 0.3 seconds. The SSR level is reduced to 10 volts until such time as the circuit breaker is closed or the cold filament warms up. The microcontroller then commences a soft start algorithm to attempt to ramp up output power to the commanded level. The soft start is accomplished by limiting PWM power command increase to 2 msec per waveform. Gating on the SSR is accomplished at 1 msec rates. If output voltage is not detected during the ramp up then output power is again reduced to 10 volts. This feature of the invention also allows a circuit breaker to be closed on a dimmer commanded to full without having a power surge that might trip the circuit breaker.

Communications between the microcontrollers in the individual dimmer modules and the control modules in the present invention is accomplished through serial communications as previously described. Module type detection is accomplished upon insertion of a dimmer module into a rack slot. Presence of the module is sensed by the control module holding the communication line 312 high. The control module then interrogates the dimmer module through a standard serial communications protocol to which the dimmer module microcontroller responds with a type report including software revision and panic line status.

Upon installation in the dimmer rack each dimmer module is uncalibrated. During initial interrogation of the dimmer module by the control module the line power value communicated to the control module by the dimmer module is compared to the locally measured value and a correction factor is then calculated and incorporated into each power level command provided by the control module to that dimmer module.

The control module CPU communicates to the 48 dimmer module slots, in the embodiment shown in the drawings as previously described, through two microcontrollers using a high speed (250 K baud) serial interface. Each microcontroller communicates with 24 slots. Messages are alternately addressed by the CPU to the microcontrollers so that in general one is processing a message while the other is receiving a message. Every 50 Msec all the slots in the rack receive light level updates. Interleaved between the light level messages other communication functions are performed. In 24 time slices, each microcontroller prompts and receives a message from all of the slots under its control. Based on the responses and on the known states of the dimmer slots, a configuration or LED display message is sent to each slot during the 25th time slice.

Figure 16:
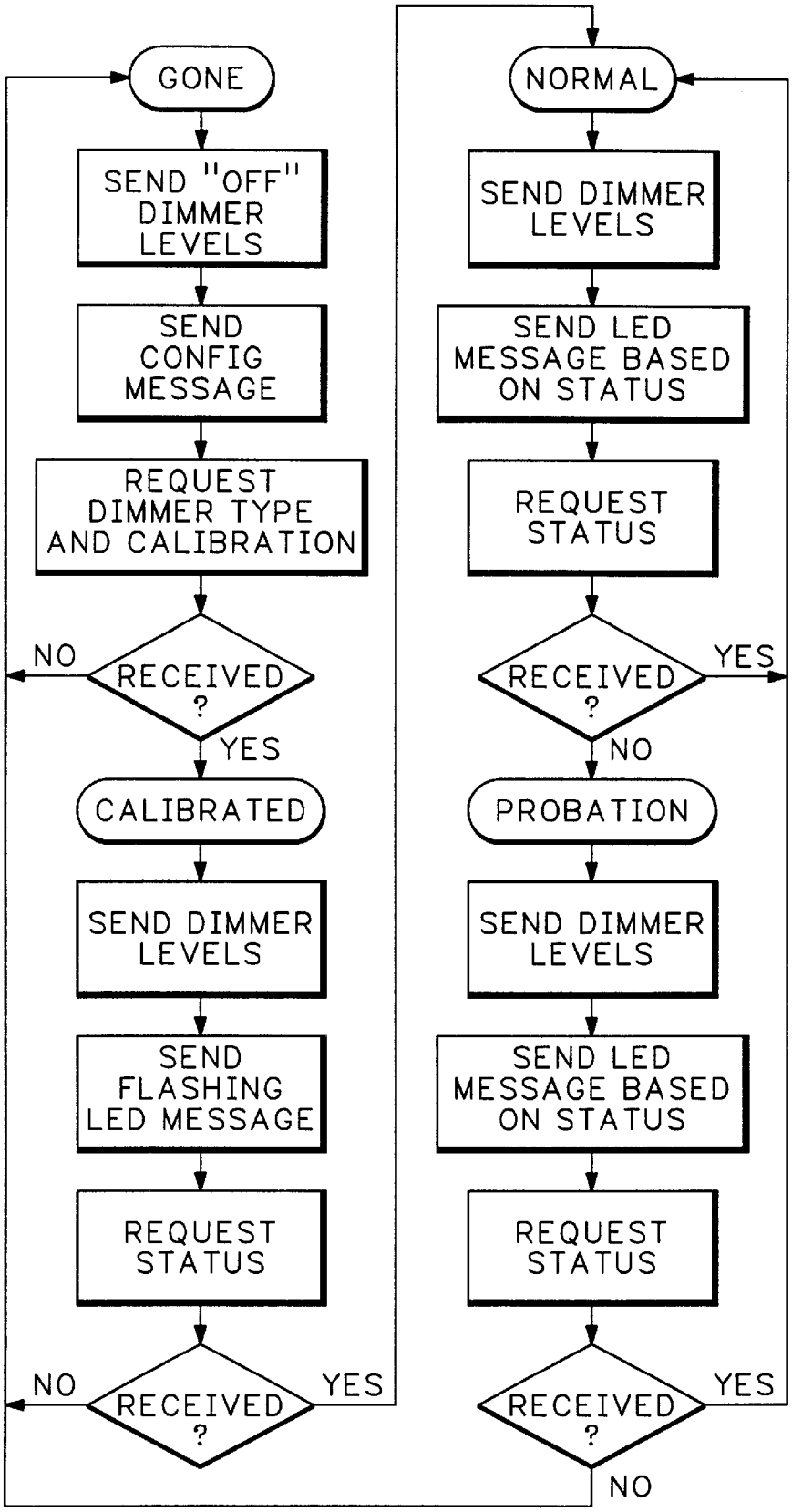
FIG. 16 is a block diagram demonstrating operation of the micro-controller for dimmer/control module communication.

As shown in FIG. 16 dimmer slot states for communications purposes are GONE, CALIBRATED, NORMAL, and PROBATION. Slots in the GONE state are provided communications for dimmer levels of "off", a configuration message during the 25th time slice, and calibration and dimmer type information is requested. Slots in the CALIBRATED state are provided communications for valid dimmer levels, a special flashing LED display message during the 25th time slice and dimmer status is requested. Slots in the NORMAL and PROBATION states are provided communications for valid dimmer levels, LED display messages based on the status response, and dimmer status is requested. Change of states for dimmer slots occur from GONE to CALIBRATED if valid configuration information is received; from CALIBRATED to NORMAL if valid status information is received and if not returns to GONE; from NORMAL to PROBATION if a communications failure occurs; from PROBATION to NORMAL if valid status information is received on second try and if not returns to GONE; and goes to GONE as a reset condition if for any reason the control module needs to recommunicate configuration to the rack (ie. for new configuration, new calibration, transitioning from off-line to on-line in the case of a redundant control situation).

Level messages consist of a header, level data for each dimmer channel in the dimmer module for that slot, and a checksum. Configuration messages consist of a header, information about each of the module LED's, and a checksum. LED messages consist of a header, information about each of the module LEDs, and a checksum. Dimmer modules respond with feedback messages in response to single character prompts. The calibration request response consists of dimmer type, dimmer software revision, panic switch settings and line frequency measurement, a line voltage measurement, and a checksum. The status request response consists of a status byte bit pattern, a thermal reading, current readings of the dimmer channels, and a checksum.

Figure 17:
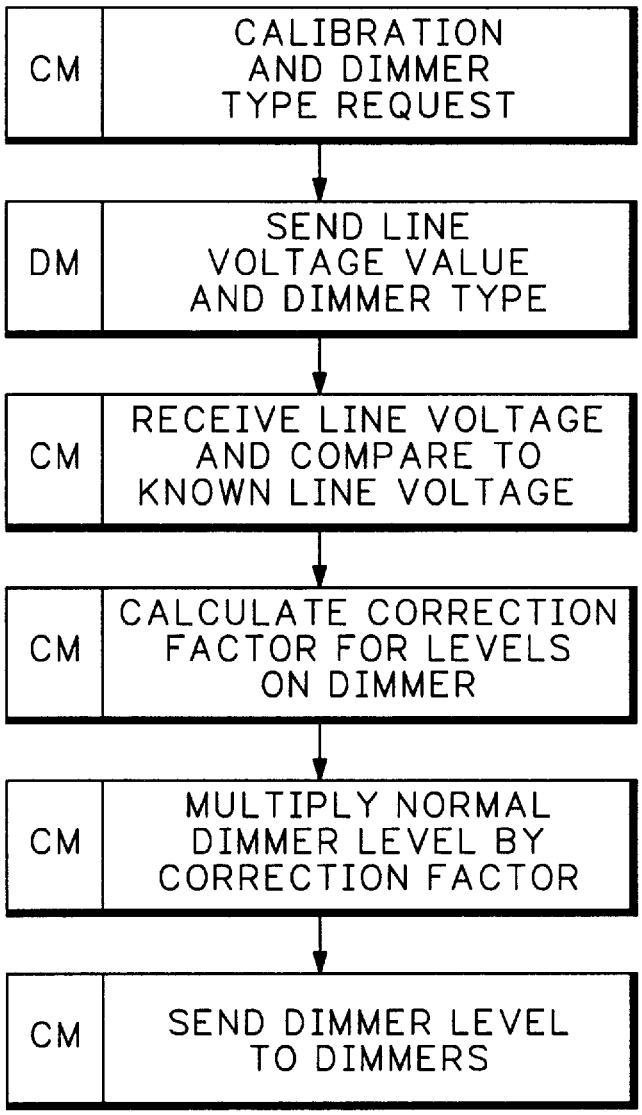
FIG. 17 is a block diagram demonstrating operation of the micro-controller for dimmer/control module interaction for dimmer calibration.
Figure 18:
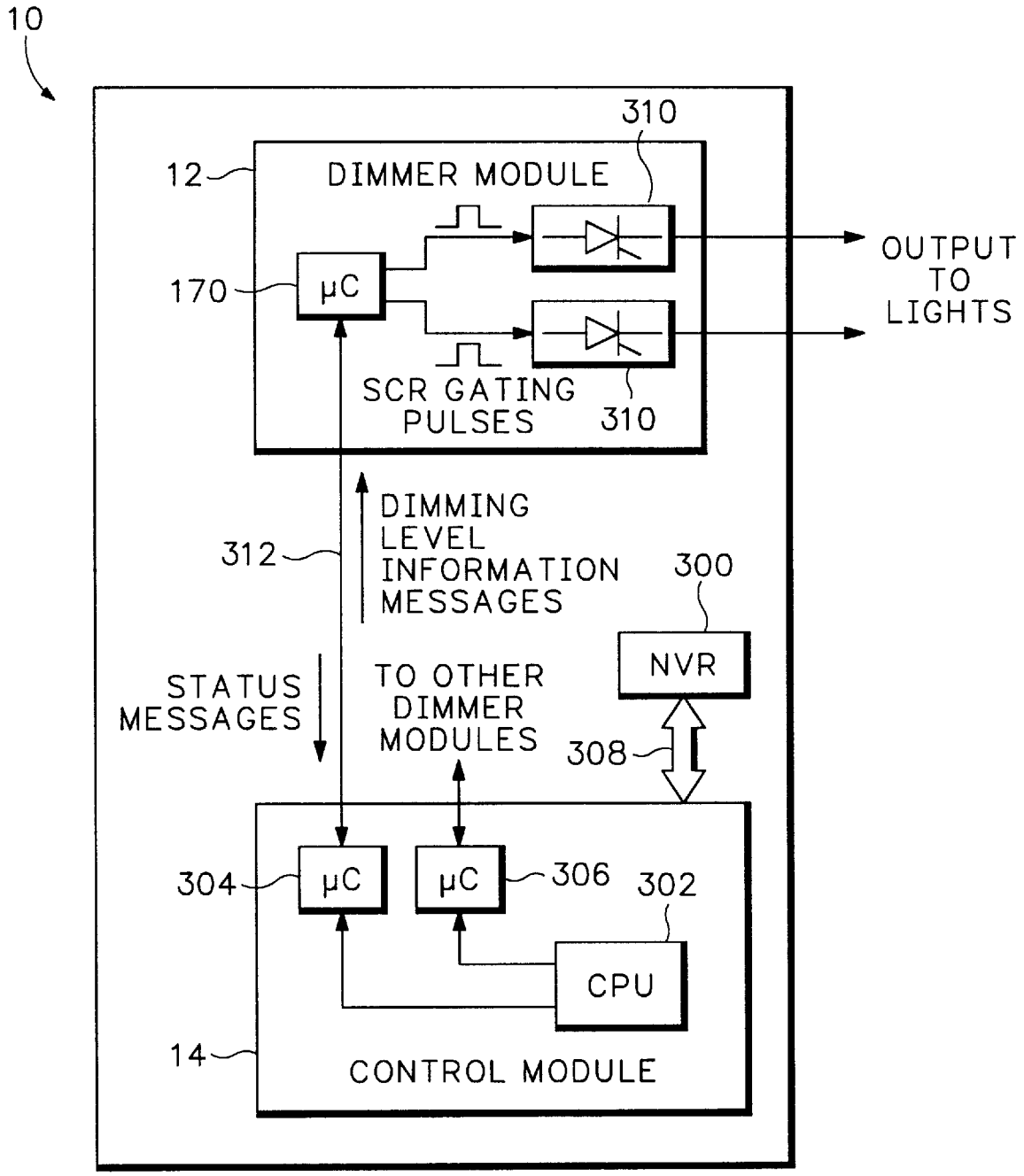
FIG. 18 is a block diagram of an embodiment of a dimming control system constructed in accordance with the present invention.

Calibration of each individual dimmer module is accomplished as shown in FIG. 17.

In operation, the complete system, comprising the present invention, including the dimmer rack, installed dimmer modules and control modules provide lighting control through a plurality of inputs. Industry standard dimming control protocol input received by the control modules is converted to lighting levels for loads controlled by the individual dimmer modules and serially communicated to the appropriate dimmer module by the control module. Similarly, lighting levels received through LAN communications by the control module are converted to dimmer levels and when appropriate "piled on" to industry standard dimming control protocol control values and/or local control values. The control modules act as a dimmer node in LAN arrangements such as that disclosed in U.S. patent application Ser. No. 08/152,489 filed Nov. 12, 1993 and having a common assignee with the present invention.

Individual dimmer control for loads controlled by the dimmer rack is accomplished through direct input by the hand held controller for the rack through command functions as previously described. Looks stored in the NVR for the rack are invoked through the hand held controller and upon loss of industry standard dimming control protocol or LAN dimmer level inputs to the control module a default look is invoked by the control module and communicated to the appropriate dimmer modules.

The individual control modules may be manually selected for operation by the operator using the module selection button 82 as previously described, however, an automatic take control feature is provided for automatic switching of control modules upon failure. The control module which is in the off-line mode must receive a pulse signal from the on-line module at predetermined intervals through dedicated communications lines between the modules. If for any reason such as software failure, electronic or power failure, the required recognition pulse is not received by the off-line module, the off-line module will assume control of the rack.

Having now described the present invention in detail as required by the patent statutes, those skilled in the art will recognize modifications and substitutions for the elements of the embodiments disclosed herein. Such modifications and substitutions are within the scope and spirit of the present invention as defined in the following claims.

What is claimed is:

1. A dimming control system with distributed command processing comprising:

a dimmer rack having a first wall and a second wall opposite the first wall, the first and second wall each having a plurality of evenly spaced corresponding supports forming a plurality of slots;

at least one power bus connector mounted adjacent the first wall;

a plurality of load connectors mounted adjacent the second wall, at least one of said second plurality of load connectors in each slot;

a plurality of board connectors mounted adjacent the second wall intermediate the load connectors and the wall, at least one of said board connectors in each slot;

a pull out tray removably engaged by the first and second wall, said tray having supports forming at least one slot to removably receive at least one control module having means for communication of dimmer control levels electrically connected to the board connectors; and at least one dimmer module having a chassis receivable in a respective one of said slots in the rack and incorporating mating connectors for the power bus, load connector and board connector associated with the respective one slot, said dimmer module further having a dimmer control circuit including a microcontroller for dimmer level control output, said microcontroller generating dimmer level control output responsive to the dimmer control levels from the communication means.

2. A dimming control system as defined in claim 1 wherein the chassis of the at least one dimmer module when received in the respective one of said slots in the rack has a first wall adjacent the first wall of the dimmer rack and a second wall adjacent the second wall of the dimmer rack, said chassis second wall including a protrusion and wherein the dimmer rack second wall incorporates a first engagement means adapted to receive the protrusion on the chassis wall said first engagement means intermediate adjacent supports for each slot in the dimmer rack.

3. A dimming control system as defined in claim 2 wherein the first engagement means comprises a removable punch tab extending at an angle from the dimmer rack first wall and said protrusion comprises a countersink screw head having a countersink angle complimentary to the angle of the tab.

4. A dimming control system as defined in claim 1 wherein the at least one dimmer module chassis when received in a respective one of said slots in the rack has a first wall adjacent the first wall of the dimmer rack and a second wall adjacent the second wall of the dimmer rack and further comprising a resilient spring mounted to the chassis first wall for engagement of the dimmer rack first wall said resilient spring urging the chassis horizontally to bring said chassis second wall into intimate contact with said dimmer rack second wall thereby establishing a datum for tolerance measurement and said mating board connector in the dimmer module is mounted in a rear wall of the chassis proximate the chassis second wall thereby providing a high tolerance connection.

5. A dimming control system as defined in claim 4 wherein the dimmer module mating connector for the power bus is mounted in the chassis rear wall proximate said chassis first wall and said mating power connector includes a case having a slot adapted to receive the power bus connector;

a floating contact received in a transverse slot in the connector case and adapted to resiliently engage the power bus connector inserted through the slot; and a flexible conductor braid attached to the floating contact and extending from the connector case for interconnection within the dimmer module.

6. A dimming control system as defined in claim 4 wherein the chassis second wall incorporates an engagement slot parallel to the rack second wall and the rack further comprises:

an insulator prong intermediate the board connectors and the second wall adapted to engage the chassis slot thereby constraining the chassis second wall adjacent the dimmer rack second wall.

7. A dimming control system as defined in claim 1 wherein the enclosure door includes a window and a support bracket adjacent the window and further comprising:

a hand held controller adapted to generate standard dimming control protocol data, said controller having a case removably received by said door bracket and a display viewable through said door window when mounted therein; and means for connecting said controller to the at least one control module.

8. A dimming control system as defined in claim 1 further comprising a plurality of panic switches each of said plurality of panic switches associated with a respective one of the plurality of slots in the dimmer rack and operatively connected to a board connector in the respective slot and the microcontroller of each dimmer module further includes means for sensing the panic switch.

9. A dimmer control system as defined in claim 8 wherein the dimmer control circuit of each dimmer module separately controls at least two dimmers and wherein each panic switch generates at least three signals, a first signal designating activation of dimmer 1 in panic mode, a second signal indicating activation of dimmer 2 in panic mode and a third signal designating activation of dimmers 1 and 2 in panic mode, said dimmer control circuit including means for activating dimmer 1 in response to said first signal, means for activating dimmer 2 in response to said second signal, and means for activating dimmers 1 and 2 in response to said third signal in panic mode.

10. A method for control of a dimmer system having a control module for communication of dimmer control levels and at least one dimmer module with an internal microcontroller for dimmer level control output and receiving communications from said control module, said method comprising the steps of:

transmitting dimmer level information from a control module;

receiving said dimmer level information in a microcontroller integral with at least one dimmer module;

converting said dimmer level information to a dimmer level output in the microcontroller;

outputting said dimmer level output from said at least one dimmer module; and monitoring power input and output from the at least one dimmer module.

11. A method for control of a dimmer system as defined in claim 10 wherein the step of transmitting dimmer level information is preceded by:

transmitting calibration and dimmer type requests from the control module;

sending line voltage value and dimmer type from the at least one dimmer module to the control module; and calibrating said at least one dimmer module in the control module for transmission of dimmer level information.

12. A method for control of a dimmer system as defined in claim 11 wherein the step of calibrating the at least one dimmer module comprises the steps of:

receiving line voltage value from the dimmer module and comparing to known line voltage;

calculating a correction factor for levels on the dimmer; and wherein the step of transmitting dimmer level information includes the step of multiplying the dimmer level by the correction factor.

13. A method for control of a dimmer system as defined in claim 10 wherein prior to the step of transmitting dimmer level information the following steps are performed:

setting the dimmer status to "gone";

transmitting "off" dimmer levels from the control module;

sending a configuration message from the control module;

requesting dimmer type and calibration;

changing configuration status to "calibrated" upon receipt of calibration data from the microcontroller of the at least one dimmer module; and wherein subsequent to the step of transmitting dimmer level information the following steps are performed:

requesting status from the at least one dimmer module by the control module;

setting the status of the at least one dimmer module to "normal" upon receipt of the requested status.

14. A method for control of dimmer modules as defined in claim 13 wherein a status setting of "normal" is present subsequent to the step of transmitting dimmer level information the following steps are performed:

requesting status information from the at least one dimmer module;

setting status to "probation" upon not receiving status information from the at least one dimmer module;

transmitting dimmer level information from the control module;

requesting status from the at least one dimmer module;

resetting the dimmer status to "normal" upon receipt of status information; and alternatively setting dimmer status to "gone" upon not receiving status information.

15. A method for control of a dimmer module system as defined in claim 13 wherein subsequent to the step of requesting status is the step of setting the status of the at least one dimmer module to "gone" upon not receiving status information.

16. A method for control of a dimmer system as defined in claim 10 wherein the step of monitoring power input and output includes predicting zero cross detection comprising the steps of:

initiating a predetermined sampling window;

examining voltage value for actual zero cross;

calculating upon actual zero detection the difference between actual zero cross and predicted zero cross in the microcontroller and storing an error value;

clamping the error value to predetermined value upon completion of the sampling window without an actual zero detection;

incrementing a reset counter;

determining if the counter value equals a threshold value;

setting the error value to zero if the counter does not equal the threshold value;

applying a filter to the error value to obtain a filtered error value;

adding the filtered error value to the line power wave form for predicted zero cross;

decrementing a reset counter;

resetting the microcontroller if the counter value exceeds 50.

17. A method for control of a dimmer system as defined in claim 16 wherein the step of applying a filter comprises the steps of:

recalling prior zero cross error values;

discarding high and low error values; and averaging the remaining values to provide a median filtered error value.

18. A method for control of a dimmer system as defined in claim 10 wherein the step of monitoring power input and output includes the steps of:

reading voltage from a power measurement circuit by the microcontroller;

performing a table lookup of the measured value of output power;

sampling line voltage at a predetermined frequency;

determining the sum of the squares of sample values;

determining if a power waveform half cycle is complete;

comparing the sum of the squares of sampled voltage values to the square of an ideal voltage output upon completion of a power half cycle; and servoing the output level based on the comparison of sampled and ideal voltage.

19. A method for control of a dimmer system as defined in claim 10 wherein the step of monitoring power input and output includes the steps of:

monitoring power output for a negative half cycle;

determining if output power is commanded during the negative half cycle;

determining if a voltage is present;

reporting an open circuit upon determination of presence of a voltage and no output power commanded;

reporting an error condition upon a determination of commanded power output and no voltage presence; and performing a soft start power ramp.

20. A method for control of a dimmer system as defined in claim 17 wherein the step of performing a soft start power ramp includes the steps of:

increasing the pulse width modulation over a predetermined period;

determining if a voltage is present;

determining if a preset number of cycles of the ramp have been performed upon a determination of no voltage present;

commanding a dimmer level upon completion of the preset number of cycles; and cancelling the error condition upon determining presence of a voltage.

21. A dimming control system as defined in claim 1 wherein the dimmer rack further includes an enclosure door.

22. A dimming control system as defined in claim 1 wherein the pull out tray further includes a backplane incorporating connectors for the control module to receive industry standard dimming control protocol data.

23. A dimming control system as defined in claim 22 wherein the backplane incorporates a nonvolatile random access memory device (NVR) and means for interfacing the NVR to the control module.

24. A method for control of a dimmer system having a control module for communication of dimmer control levels and at least one dimmer module with an internal microcontroller for dimmer level control output and receiving communications from said control module, said method comprising the steps of:

transmitting dimmer level information from a control module;

receiving said dimmer level information in a microcontroller integral with at least one dimmer module;

converting said dimmer level information to a dimmer level output in the microcontroller; and outputting said dimmer level output from said at least one dimmer module.

25. A method for control of a dimmer system as defined in claim 24 wherein the step of transmitting dimmer level information is preceded by:

transmitting calibration and dimmer type requests from the control module;

sending line voltage value and dimmer type from the at least one dimmer module to the control module; and calibrating said at least one dimmer module in the control module for transmission of dimmer level information.

26. A method for control of a dimmer system as defined in claim 25 wherein the step of calibrating the at least one dimmer module comprises the steps of:

receiving line voltage value from the dimmer module and comparing to known line voltage;

calculating a correction factor for levels on the dimmer; and wherein the step of transmitting dimmer level information includes the step of multiplying the dimmer level by the correction factor.

27. A method for control of a dimmer system as defined in claim 24 wherein prior to the step of transmitting dimmer level information the following steps are performed:

setting the dimmer status to "gone";

transmitting "off" dimmer levels from the control module;

sending a configuration message from the control module;

requesting dimmer type and calibration;

changing configuration status to "calibrated" upon receipt of calibration data from the microcontroller of the at least one dimmer module; and wherein subsequent to the step of transmitting dimmer level information the following steps are performed:

requesting status from the at least one dimmer module by the control module;

setting the status of the at least one dimmer module to "normal" upon receipt of the requested status.

28. A method for control of dimmer modules as defined in claim 27 wherein a status setting of "normal" is present subsequent to the step of transmitting dimmer level information the following steps are performed:

requesting status information from the at least one dimmer module;

setting status to "probation" upon not receiving status information from the at least one dimmer module;

transmitting dimmer level information from the control module;

requesting status from the at least one dimmer module;

resetting the dimmer status to "normal" upon receipt of status information; and alternatively setting dimmer status to "gone" upon not receiving status information.

29. A method for control of a dimmer module system as defined in claim 27 wherein subsequent to the step of requesting status is the step of setting the status of the at least one dimmer module to "gone" upon not receiving status information.

30. A dimming control system comprising:

a rack;

a dimmer module mounted in the rack; and a control module mounted in the rack and communicatively coupled to the dimmer module;

the control module including logic circuitry for transmitting dimming level information to the dimmer;

the dimmer module including logic circuitry coupled to receive the dimming level information from the control module and control power to a load responsive to the dimming level information.

31. A system according to claim 30 wherein the dimmer module includes circuitry for transmitting messages from the dimmer module to the control module.

32. A system according to claim 30 wherein the rack includes a pull-out tray for removably receiving the control module.

33. A system according to claim 30 wherein the rack includes a backplane having connectors for communicatively coupling the control module to the dimmer module.

34. A system according to claim 30 wherein the rack includes a nonvolatile memory device coupled to the control module.

35. A system according to claim 30 wherein the rack includes:

a first wall having a plurality of supports;

a second wall having a plurality of supports, the second wall located opposite the first wall such that the plurality of supports on the first and second walls form a plurality of slots;

a power bus connector mounted adjacent the first wall;

a plurality of load connectors mounted adjacent the second wall, each load connector corresponding to one of the slots; and a plurality of control signal connectors mounted adjacent the second wall intermediate the load connectors and the second wall, each control signal connector corresponding to one of the slots.

36. A system according to claim 35 wherein the dimmer module includes a chassis receivable in one of the slots, and mating connectors for the power bus, load connector and control signal connector corresponding to the one slot.

37. A system according to claim 30 wherein the circuitry for transmitting dimming level information to the dimmer includes a microprocessor for encoding dimming level information.

38. A system according to claim 30 wherein the circuitry for receiving the dimming level information includes a microprocessor for decoding the dimming level information received from the control module.

39. A dimming control system comprising:

a rack;

a control module mounted in the rack and including means for transmitting dimming level information; and a dimmer module mounted in the rack and including:

a dimmer circuit having a power switch for controlling power to a load responsive to a gate signal; and means for receiving dimming level information and generating the gate signal responsive to the dimming level information.

40. A dimmer module comprising:

a dimmer circuit including a power switch for controlling power to a load;

a communication port for receiving digital dimming level information; and logic circuitry coupled to the communication port to receive and decode the dimming level information and coupled to the dimmer circuit to control the dimmer circuit responsive to the digital dimming level information.

41. A control module for a rack mounted dimming control system, the module comprising:

means for receiving standard dimming control input;

means for converting the standard dimming control input to dimming level information; and means for communicating the dimming level information to one or more dimming modules.

* * * * *

UNITED STATES PATENT AND TRADEMARK OFFICE

CERTIFICATE OF CORRECTION

PATENT NO. : 5,770,928

DATED : June 23, 1998

INVENTOR(S) : Chansky et al.

It is certified that error appears in the above-identified patent and that said Letters Patent is hereby corrected as shown below:

Column 10, line 51 "by serving on the sum" should read --by servoing on the sum--.

Signed and Sealed this

Twenty-fifth Day of July, 2000

*Attest:*

*Attesting Officer*

Q. TODD DICKINSON

*Director of Patents and Trademarks*